US010828922B2

(12) United States Patent
Fukunaga

(10) Patent No.: US 10,828,922 B2
(45) Date of Patent: Nov. 10, 2020

(54) THERMAL TRANSFER RECORDING MEDIUM

(71) Applicant: TOPPAN PRINTING CO., LTD., Tokyo (JP)

(72) Inventor: Godai Fukunaga, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 309 days.

(21) Appl. No.: 16/044,915

(22) Filed: Jul. 25, 2018

(65) Prior Publication Data

US 2018/0326772 A1 Nov. 15, 2018

Related U.S. Application Data

(63) Continuation of application No. PCT/JP2017/005752, filed on Feb. 16, 2017.

(30) Foreign Application Priority Data

Feb. 29, 2016 (JP) ..... 2016-037648

(51) Int. Cl.
*B41M 5/382* (2006.01)
*B41M 5/44* (2006.01)
*B41M 5/395* (2006.01)

(52) U.S. Cl.
CPC ..... *B41M 5/38214* (2013.01); *B41M 5/395* (2013.01); *B41M 5/44* (2013.01); (Continued)

(58) Field of Classification Search
CPC .... B41M 5/38214; B41M 5/395; B41M 5/44; B41M 2205/02; B41M 2205/06; B41M 2205/30; B41M 2205/36; B41M 2205/38
See application file for complete search history.

(56) References Cited

U.S. PATENT DOCUMENTS 10,675,901 B2 * 6/2020 Fukunaga ..... B41M 5/42

FOREIGN PATENT DOCUMENTS

JP H05-131760 A 5/1993
JP 2005-231354 A 9/2005

OTHER PUBLICATIONS

International Search Report with English language translation and Written Opinion issued in International Application No. PCT/JP2017/005752 dated Mar. 21, 2017.

* cited by examiner

*Primary Examiner* — Gerard Higgins
(74) *Attorney, Agent, or Firm* — Foley & Lardner LLP

(57) ABSTRACT

A thermal transfer recording medium that satisfies the requirements for higher printing speed of thermal transfer, and high density and high quality of thermal transfer images, that better prevents the occurrence of abnormal transfer under high-temperature and high-humidity conditions, and that improves transfer sensitivity in printing. The thermal transfer recording medium includes a primer layer, an undercoat layer, and a dye layer in this order on one surface of a substrate, and a heat-resistant lubricating layer on the other surface of the substrate; wherein the primer layer contains polycarbonate and a polyurethane-urea resin having a polycaprolactam skeleton; the undercoat layer contains a copolymer of polyester and acrylic, and polyvinyl pyrrolidone; and the copolymer is a copolymer of polyester having a sulfonic acid group, and acrylic having at least one of a glycidyl group and a carboxyl group.

7 Claims, 1 Drawing Sheet

(52) U.S. Cl.
CPC ..... *B41M 2205/02* (2013.01); *B41M 2205/06* (2013.01); *B41M 2205/30* (2013.01); *B41M 2205/36* (2013.01); *B41M 2205/38* (2013.01)

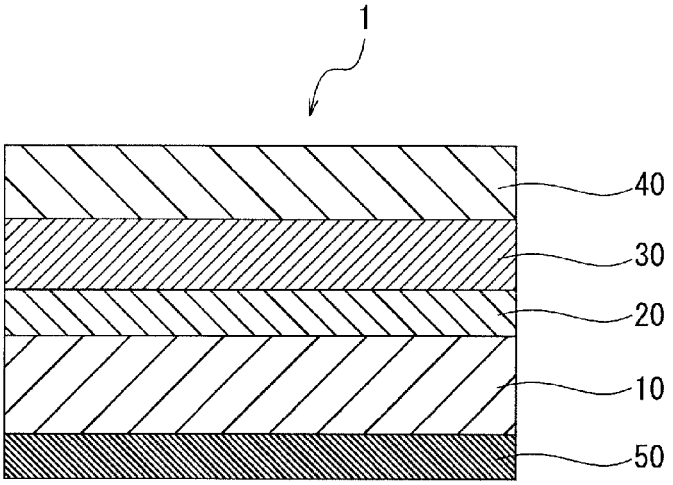
1
40
30
20
10
50

THERMAL TRANSFER RECORDING MEDIUM

CROSS-REFERENCE TO RELATED PATENT APPLICATIONS

This application is a continuation application filed under 35 U.S.C. § 111(a) claiming the benefit under 35 U.S.C. §§ 120 and 365(c) of International Patent Application No. PCT/JP2017/005752, filed on Feb. 16, 2017, which is based upon and claims the benefit of priority to Japanese Patent Application No. 2016-037648, filed on Feb. 29, 2016, the disclosures of which are all hereby incorporated herein by reference in their entireties.

TECHNICAL FIELD

The present invention relates to a thermal transfer recording medium.

BACKGROUND OF THE INVENTION

Thermal transfer recording media are generally called thermal ribbons, and are used, for example, for ink ribbons of thermal transfer printers.

Conventional thermal transfer recording media are disclosed, for example, in PTL 1 and PTL 2. PTL 1 and PTL 2 each disclose a thermal transfer recording medium comprising a thermal transfer layer on one surface of a substrate, and a heat-resistant lubricating layer (a back coat layer) on the other surface of the substrate. Here, the thermal transfer layer comprises a layer containing ink (a dye layer), from which the ink is sublimated (sublimation transfer printing) or fused (fusion transfer printing) by the heat generated by the thermal head of the printer, and transferred to a transfer object (a thermal transfer image-receiving sheet).

Known thermal transfer image-receiving sheets are "solvent-based thermal transfer image-receiving sheets" comprising a solvent-based dye-receiving layer (an image-receiving layer), and "water-based thermal transfer image-receiving sheets" comprising a water-based dye-receiving layer; however, in terms of environmental concerns and safety issues, it is desired to form each layer of the image-receiving sheet using a water-based coating liquid. However, compared with solvent-based thermal transfer image-receiving sheets, water-based thermal transfer image-receiving sheets are more inferior in releasability between the dye layer and the dye-receiving layer. Therefore, water-based thermal transfer image-receiving sheets are likely to undergo thermal fusion between the dye layer and the dye-receiving layer; thus, transfer sensitivity tends to be reduced, and abnormal transfer, in which the dye layer is transferred to the dye-receiving layer, tends to occur easily.

When the present inventors actually performed printing by a currently-known sublimation transfer high-speed printer using water-based thermal transfer image-receiving sheets in combination with thermal transfer recording media having the structure disclosed in PTL 1 and PTL 2, sufficient printing density was not obtained, or abnormal transfer occurred during thermal transfer; thus, print objects of sufficiently satisfactory quality were not obtained.

[Citation List] [Patent Literature] [PTL 1] JP H05-131760 A; [PTL 2] JP 2005-231354 A

SUMMARY OF THE INVENTION

Technical Problem

The present invention was made focusing on the above points, and an object of the present invention is to provide a thermal transfer recording medium that can better prevent the occurrence of abnormal transfer and improve transfer sensitivity in printing when printing is performed using the thermal transfer recording medium in combination with a water-based thermal transfer image-receiving sheet.

Solution to Problem

The thermal transfer recording medium according to one embodiment of the present invention is a thermal transfer recording medium comprising a heat-resistant lubricating layer on one surface of a substrate, and a primer layer, an undercoat layer, and a dye layer sequentially laminated on the other surface of the substrate; wherein the primer layer contains polycarbonate and a polyurethane-urea resin having a polycaprolactam skeleton; the undercoat layer contains a copolymer of polyester and acrylic, and polyvinyl pyrrolidone; and the copolymer is a copolymer of polyester having a sulfonic acid group, and acrylic having at least one of a glycidyl group and a carboxyl group.

Advantageous Effects of the Invention

According to one embodiment of the present invention, when a water-based thermal transfer image-receiving sheet is used, transfer sensitivity during high-speed printing can be improved, and the occurrence of abnormal transfer can be better prevented.

BRIEF DESCRIPTION OF THE DRAWINGS

The FIGURE is a schematic cross-sectional view showing the structure of a thermal transfer recording medium according to one embodiment of the present invention.

DESCRIPTION OF THE REPRESENTATIVE EMBODIMENTS

One embodiment of the present invention is described below with reference to the drawing.

In the following detailed description, many specific details are described for understanding of the present invention. However, it should be clear that one or more embodiments can be carried out without such specific details. That is, embodiments other than these embodiments can be modified in various ways depending on the design etc., within the scope that does not depart from the technical idea according to the present invention. In addition, the descriptions of well-known structures and devices are omitted, in order to make the drawing simple. Moreover, the drawing is schematic, and the relationship between thickness and planar size, the ratio of the thickness of each layer, etc., are different from the actual ones.

(Thermal Transfer Recording Medium 1)

The thermal transfer recording medium 1 according to one embodiment of the present invention is a thermal transfer recording medium for forming an image by thermal transfer on a thermal transfer image-receiving sheet in which a water-based receiving layer containing a water-based binder and a mold-releasing agent is formed on a substrate through a water-based hollow particle layer containing at least a water-based binder and hollow particles.

In the thermal transfer recording medium 1 according to the present embodiment, a primer layer 20, an undercoat layer 30, and a dye layer 40 are formed in this order on one surface (front surface) of a substrate 10, as shown in the FIGURE. Further, a heat-resistant lubricating layer 50, which imparts sliding properties against thermal heads, is formed on the other surface (back surface) of the substrate 10. The details of these members are explained below.

(Substrate 10)

The substrate 10 is required to have heat resistance and strength to sufficiently prevent softening deformation due to thermal pressure during thermal transfer. Accordingly, examples of the substrate 10 include films of synthetic resins, such as polyethylene terephthalate, polyethylene naphthalate, polypropylene, cellophane, acetate, polycarbonate, polysulfone, polyimide, polyvinyl alcohol, aromatic polyamide, aramid, and polystyrene; paper, such as condenser paper and paraffin paper; and composites of thereof. Among these, polyethylene terephthalate films are preferable in terms of physical properties, processability, cost, etc.

Moreover, the substrate 10 can be one having a thickness within a range of 2 μm or more and 50 μm or less, in terms of operability and processability. In this range, the thickness is preferably within a range of 2 μm or more and 9 μm or less, in terms of handling properties, such as transferability and processability.

(Primer Layer 20)

The primer layer 20 contains polycarbonate and a polyurethane-urea resin having a polycaprolactam skeleton.

Because an undercoat layer 30, described later, is formed, and the above primer layer 20 is formed between the substrate 10 and the undercoat layer 30, abnormal transfer does not occur even when a water-based thermal transfer image-receiving sheet is used, and high-density printing can be achieved without increasing the amount of dye used in the dye layer 40.

The term "abnormal transfer" as mentioned herein refers to a phenomenon in which the dye layer 40 is peeled from the substrate 10 during thermal transfer, and the dye layer 40 and the transfer object are fused to each other.

Abnormal transfer tends to occur significantly particularly in a high-temperature and high-humidity environment. In consideration of this, the primer layer 20 preferably contains a polyisocyanate, in addition to polycarbonate and a polyurethane-urea resin having a polycaprolactam skeleton mentioned above. The formation of the primer layer 20 containing a polyisocyanate between the substrate 10 and the undercoat layer 30 makes it possible to provide the thermal transfer recording medium 1 that can suppress abnormal transfer after storage in a high-temperature and high-humidity environment, and that can achieve high-density printing without increasing the amount of dye used in the dye layer 40.

(Undercoat Layer 30)

The undercoat layer 30 contains a copolymer of polyester and acrylic (a polyester-acrylic copolymer), and polyvinyl pyrrolidone. The polyester-acrylic copolymer is a copolymer of polyester having a sulfonic acid group in a side chain, and acrylic having at least one of a glycidyl group and a carboxyl group.

The undercoat layer 30 is required, not only to sufficiently prevent abnormal transfer, as mentioned above, but also to have dye barrier properties for improving transfer sensitivity, and further solvent resistance for allowing the dye layer 40, which generally contains a solvent, to be laminated on the undercoat layer 30. Therefore, a polyester-acrylic copolymer and polyvinyl pyrrolidone are used as main components of the undercoat layer 30.

The term "dye barrier properties" as mentioned herein means the ability to better block (prevent) diffusion of the dye contained in the dye layer 40 towards the substrate 10.

Moreover, the term "main components" indicates that components other than a polyester-acrylic copolymer and polyvinyl pyrrolidone may further be added, as long as the effects of the present embodiment are not impaired. Specifically, a polyester-acrylic copolymer and polyvinyl pyrrolidone are contained more than 50 mass % based on the whole undercoat layer 30 when formed.

Here, the ratio of a polyester-acrylic copolymer and polyvinyl pyrrolidone in the undercoat layer 30 is preferably 90 mass % or more.

The polyester component contained in the undercoat layer 30 is essential to achieve adhesion to the primer layer 20. Moreover, the acrylic component contained in the undercoat layer 30 is essential to achieve dye barrier properties and solvent resistance.

However, when the polyester component and the acrylic component are simply blended, the stability as a material is insufficient because the polyester component and the acrylic component are poorly compatible with each other.

Furthermore, the adhesion of the polyester component to the primer layer 20, and the solvent resistance and dye barrier properties of the acrylic component cannot be obtained, consequently reducing performance, as compared with when each component is used singly.

This is considered to be because an incompatible sea-island structure is formed by blending the poorly compatible polymers, and the polyester component, which has adhesion, and the acrylic component, which has dye barrier properties, which are present locally. That is, this is considered to be because portions with low adhesion and portions with low dye barrier properties are present in the undercoat layer 30 when viewed as a whole.

Meanwhile, the poor compatibility can be improved by copolymerizing the polyester component and the acrylic component. The polyester component and the acrylic component thereby do not undergo phase separation, and the polyester component and the acrylic component are present in the entire undercoat layer 30; thus, the function of each component (e.g., adhesion, solvent resistance, and dye barrier properties) is considered to be effectively exhibited.

[Details of Polyester Component]

The details of the polyester component contained in the undercoat layer 30 are explained below.

The dicarboxylic acid component, which is a copolymerization component of the polyester contained in the undercoat layer 30, comprises an ester-forming sulfonic acid alkali metal salt compound as an essential component, and examples thereof include aromatic dicarboxylic acids, such as phthalic acid, terephthalic acid, dimethyl terephthalate, isophthalic acid, dimethyl isophthalate, 2,5-dimethylterephthalic acid, 2,6-naphthalenedicarboxylic acid, biphenyldicarboxylic acid, and orthophthalic acid; aliphatic dicarboxylic acids, such as succinic acid, adipic acid, azelaic acid, sebacic acid, and dodecanedicarboxylic acid; alicyclic dicarboxylic acids, such as cyclohexanedicarboxylic acid; and the like.

Dicarboxylic acid components other than the ester-forming sulfonic acid alkali metal salt compound are preferably aromatic dicarboxylic acids, for example.

This is because aromatic dicarboxylic acids are excellent in improving adhesion and have excellent hydrolysis resistance due to their nucleus having high affinity to hydrophobic plastic. In the present embodiment, terephthalic acid and isophthalic acid are particularly preferable.

Moreover, examples of the ester-forming sulfonic acid alkali metal salt compound include alkali metal salts of sulfoterephthalic acid, 5-sulfoisophthalic acid, 4-sulfoisophthalic acid, or 4-sulfonaphthalene acid-2,7-dicarboxylic acid (alkali metal salts of sulfonic acids), and ester-forming derivatives thereof; sodium salts of 5-sulfoisophthalic acid and ester-forming derivatives thereof are more preferably used.

This is because solvent resistance is improved due to the presence of a sulfonic acid group.

Examples of the diglycol component, which is a copolymerization component of the polyester contained in the undercoat layer 30, include diethylene glycol and $C_2$-$C_5$ aliphatic or $C_6$-$C_{12}$ alicyclic glycols. Specific examples of $C_2$-$C_5$ aliphatic or $C_6$-$C_{12}$ alicyclic glycols include ethylene glycol, 1,3-propanediol, 1,2-propylene glycol, neopentyl glycol, 1,4-butanediol, 1,4-cyclohexanedimethanol, 1,3-cyclohexanedimethanol, 1,2-cyclohexanedimethanol, 1,6-hexanediol, p-xylylene glycol, triethylene glycol, and the like; these may be used singly or in combination of two or more.

[Details of Acrylic Component]

The details of the acrylic component contained in the undercoat layer 30 are explained below.

The acrylic component contained in the undercoat layer 30 is, for example, a glycidyl group-containing radical polymerizable unsaturated monomer alone, a carboxyl group-containing radical polymerizable unsaturated monomer alone, or other radical polymerizable unsaturated monomers that can be copolymerized with the above monomers.

The present embodiment requires a glycidyl group-containing radical polymerizable unsaturated monomer or a carboxyl group-containing radical polymerizable unsaturated monomer.

This is because the glycidyl group and the carboxyl group have poor compatibility with dyes, and thus have dye barrier properties.

That is, transfer sensitivity is improved by using an acrylic component having at least one of a glycidyl group and a carboxyl group in the undercoat layer 30. Further, solvent resistance to, for example, acetone, methyl ethyl ketone, and similar ketone solvents, as well as ethyl acetate, butyl acetate, and similar ester solvents, is improved. Moreover, in the present embodiment, transfer sensitivity is further improved by the reaction of the glycidyl group or the carboxyl group with hydroxyl groups and residual amine groups contained in the primer layer 20, described later.

Examples of the glycidyl group-containing radical polymerizable unsaturated monomer include glycidyl ethers, such as glycidyl acrylate, glycidyl methacrylate, and allyl glycidyl ether.

Further, examples of the carboxyl group-containing radical polymerizable unsaturated monomer include acrylic acid, methacrylic acid, crotonic acid, itaconic acid, maleic acid, fumaric acid, 2-carboxyethyl (meth)acrylate, 2-carboxypropyl (meth)acrylate, 5-carboxypentyl (meth)acrylate, and the like.

Examples of radical polymerizable unsaturated monomers that can be copolymerized with the glycidyl group-containing radical polymerizable unsaturated monomer or the carboxyl group-containing radical polymerizable unsaturated monomer include vinyl esters, unsaturated carboxylic acid esters, unsaturated carboxylic acid amides, unsaturated nitriles, allyl compounds, nitrogen-containing vinyl monomers, hydrocarbon vinyl monomers, and vinyl silane compounds.

Examples of vinyl esters mentioned above include vinyl propionate, vinyl stearate, higher tertiary vinyl ester, vinyl chloride, and vinyl bromide.

Moreover, examples of unsaturated carboxylic acid esters mentioned above include methyl acrylate, ethyl acrylate, butyl acrylate, 2-ethylhexyl acrylate, methyl methacrylate, ethyl methacrylate, butyl methacrylate, butyl maleate, octyl maleate, butyl fumarate, octyl fumarate, hydroxyethyl methacrylate, hydroxyethyl acrylate, hydroxypropyl methacrylate, hydroxypropyl acrylate, dimethylaminoethyl methacrylate, dimethylaminoethyl acrylate, ethylene glycol dimethacrylate ester, ethylene glycol diacrylate ester, polyethylene glycol dimethacrylate ester, and polyethylene glycol diacrylate ester.

Moreover, examples of unsaturated carboxylic acid amides mentioned above include acrylamide, methacrylamide, methylol acrylamide, and butoxymethylol acrylamide.

Moreover, examples of unsaturated nitriles mentioned above include acrylonitrile.

Moreover, examples of allyl compounds mentioned above include allyl acetate, allyl methacrylate, allyl acrylate, and diallyl itaconate.

Moreover, examples of nitrogen-containing vinyl monomers mentioned above include vinylpyridine and vinylimidazole.

Moreover, examples of hydrocarbon vinyl monomers mentioned above include ethylene, propylene, hexene, octene, styrene, vinyl toluene, and butadiene.

Moreover, examples of vinyl silane compounds mentioned above include dimethylvinylmethoxysilane, dimethylvinylethoxysilane, methylvinyldimethoxysilane, methylvinyldiethoxysilane, γ-methacryloxypropyltrimethoxysilane, and γ-methacryloxypropyldimethoxysilane.

The copolymerization ratio of polyester and acrylic in the undercoat layer 30 is preferably within a range of 20:80 to 40:60 by mass ratio.

This is because when the amount of the polyester component is less than 20% in the undercoat layer 30, high printing density is obtained, but adhesion to the primer layer 20 tends to be insufficient, whereas when the amount of the polyester component exceeds 40%, adhesion is improved, but the printing density tends to be reduced.

The polyester contained in the undercoat layer 30 can be obtained by a production method comprising subjecting dicarboxylic acid and diglycol to esterification or transesterification, followed by polycondensation, and the production method is not limited in any way.

Further, the method for producing the polyester-acrylic copolymer contained in the undercoat layer 30 is not limited in any way. For example, emulsion polymerization can be performed by a method comprising emulsifying an acrylic monomer using a polyester dispersion or aqueous solution, or a method comprising adding dropwise an acrylic monomer to a polyester dispersion or aqueous solution.

[Details of Polyvinyl Pyrrolidone]

The details of the polyvinyl pyrrolidone contained in the undercoat layer 30 are explained below.

As the present inventors found, the increase in transfer sensitivity when polyvinyl pyrrolidone is mixed with a polyester-acrylic copolymer, as compared with when both components (i.e., the copolymer and polyvinyl pyrrolidone) are used singly, is considered to be because the polyvinyl pyrrolidone is present in the vicinity of the polyester part having a sulfonic acid group in the copolymer, which easily adsorbs dyes, to thereby better prevent adsorption of the dye.

Moreover, the composition ratio of the polyester-acrylic copolymer and the polyvinyl pyrrolidone is preferably within a range of 70:30 to 20:80 by mass ratio.

This is because when the ratio of polyvinyl pyrrolidone is less than 30%, high printing density is less likely to be obtained, and when the ratio of polyvinyl pyrrolidone exceeds 80%, high printing density is less likely to be obtained and the storage stability is reduced due to the hygroscopicity of polyvinyl pyrrolidone.

Examples of polyvinyl pyrrolidone include homopolymers or copolymers of vinyl pyrrolidone, such as N-vinyl-2-pyrrolidone and N-vinyl-4-pyrrolidone. Further, a modified polyvinyl pyrrolidone resin etc. can also be used.

The modified polyvinyl pyrrolidone resin is, for example, a copolymer of an N-vinyl pyrrolidone-based monomer and other monomers. Examples of the copolymerization form of the copolymer include, but are not particularly limited to, random copolymerization, block copolymerization, graft copolymerization, and the like.

Examples of the N-vinyl pyrrolidone-based monomer include N-vinyl pyrrolidone (N-vinyl-2-pyrrolidone, N-vinyl-4-pyrrolidone, etc.) and derivatives thereof. Examples of derivatives thereof include, but are not particularly limited to, N-vinyl-3-methylpyrrolidone, N-vinyl-5-methylpyrrolidone, N-vinyl-3,3,5-trimethylpyrrolidone, N-vinyl-3-benzylpyrrolidone, and the like that have a sub stituent on a pyrrolidone ring.

Examples of other monomers that can be copolymerized with the N-vinyl pyrrolidone-based monomer include vinyl polymerizable monomers. Specific examples thereof include (meth)acrylic monomers, such as (meth)acrylic acid, methyl (meth)acrylate, ethyl (meth)acrylate, and isopropyl (meth) acrylate; unsaturated carboxylic acids, such as fumaric acid, maleic acid, and itaconic acid; vinylcaprolactam, ethylene, propylene, vinyl chloride, vinyl acetate, vinyl alcohol, styrene, vinyl toluene, divinylbenzene, vinylidene chloride, tetrafluoroethylene, vinylidene fluoride, and the like.

The polyvinyl pyrrolidone used in the undercoat layer 30 of the present embodiment preferably has a K value, designated by the Fikentscher formula, within a range of 30 or more and 100 or less. The K value is particularly preferably within a range of 60 or more and 90 or less. If polyvinyl pyrrolidone having a K value of less than 30 is used, the effect of improving transfer sensitivity in printing is weak, whereas if polyvinyl pyrrolidone having a K value exceeding 100 is used, the viscosity of the coating liquid increases to reduce coating suitability; thus, such polyvinyl pyrrolidone is not preferable.

[Coating Amount of Undercoat Layer 30 after Drying]

The coating amount of the undercoat layer 30 after drying is not generally limited, but is preferably within a range of 0.03 $g/m^2$ or more and 0.35 $g/m^2$ or less.

If the coating amount of the undercoat layer 30 after drying is less than 0.03 $g/m^2$, transfer sensitivity and adhesion during high-speed printing are insufficient, due to the deterioration of the undercoat layer 30 when the dye layer 40 is laminated.

In contrast, if the coating amount of the undercoat layer 30 after drying is more than 0.35 g/m2, the sensitivity of the thermal transfer recording medium 1 itself is not changed, and the printing density is saturated. Accordingly, the coating amount of the undercoat layer 30 after drying is preferably 0.35 g/m2 or less, in terms of cost.

The coating amount of the undercoat layer 30 after drying as mentioned herein refers to the amount of solids remaining after a coating liquid for forming the undercoat layer 30 is applied and then dried. Moreover, the coating amounts of a primer layer 20 and a dye layer 40, described later, after drying, and the coating amount of a heat-resistant lubricating layer 50, described later, after drying also refer to the amount of solids remaining after each coating liquid is applied and then dried.

(Primer Layer 20)

Transfer sensitivity is obtained when the undercoat layer 30 is formed from a polyester-acrylic copolymer and polyvinyl pyrrolidone; however, in printing combined with a water-based thermal transfer image-receiving sheet, the adhesion to the substrate 10 and the undercoat layer 30 is insufficient, and abnormal transfer occurs.

This is because, compared with solvent-based thermal transfer image-receiving sheets, water-based thermal transfer image-receiving sheets are inferior in releasability between the dye layer 40 and the dye-receiving layer, and thermal fusion is thus likely to occur between the dye layer 40 and the dye-receiving layer.

Here, the present inventors found that the use of polycarbonate and a polyurethane-urea resin having a polycaprolactam skeleton in the primer layer 20 not only better prevented abnormal transfer when a water-based thermal transfer image-receiving sheet was used, but also improved transfer sensitivity, as compared with when the undercoat layer 30 was used alone.

The reason for this is considered to be as follows: regarding adhesion, the urea bond, which is similar to an amide bond, contained in the polyurethane-urea resin has adhesion to the substrate 10 and the undercoat layer 30, and heat resistance and flexibility are improved by the presence of the polycarbonate and the polycaprolactam skeleton; thus, adhesion is not reduced even when high energy and high pressure are applied during use of a high-speed printer.

The improvement in transfer sensitivity is considered to be attributable to the following reasons: the lactam structure part of the polyvinyl pyrrolidone contained in the undercoat layer 30 and the urea bond part interact via hydrogen bonds, so that the film aggregation force of the entire primer layer 20 or undercoat layer 30 is improved, and the dye is less likely to be diffused in the primer layer 20 or the undercoat layer 30; thus, transfer sensitivity is considered to be improved.

Moreover, during storage in a high-temperature and high-humidity environment, the polyvinyl pyrrolidone contained in the undercoat layer 30 absorbs moisture, so that the undercoat layer 30 is degraded; thus, abnormal transfer is likely to occur.

To address these problems, the present inventors found that the use of a polyisocyanate, in addition to polycarbonate and a polyurethane-urea resin having a polycaprolactam skeleton, in the primer layer 20, not only better prevented abnormal transfer after storage in a high-temperature and high-humidity environment, but also improved transfer sensitivity, as compared with when the undercoat layer 30 was used alone.

In this case, the urea bond, which is similar to an amide bond, contained in the polyurethane-urea resin, has adhesion to the substrate 10 and the undercoat layer 30; in addition, the polyisocyanate reacts with hydroxyl groups and carboxyl groups present in the substrate 10 and the undercoat layer 30 to thereby suppress hygroscopicity; and further, the heat resistance of the polycarbonate and the polycaprolactam skeleton, and heat resistance obtained by the reaction of hydroxyl groups contained in the polyurethane-urea resin and the polyisocyanate are improved. As a result, adhesion is not reduced even when high energy and high pressure are applied during use of a high-speed printer in a high-temperature and high-humidity environment.

Moreover, in this case, the improvement in transfer sensitivity is considered to be attributable to the following reasons: the lactam structure part of the polyvinyl pyrrolidone contained in the undercoat layer 30 and the urea bond part interact through hydrogen bonds, and the glycidyl group and epoxy group contained in the undercoat layer 30 react with the polyisocyanate, so that the film aggregation force of the entire primer layer 20 or undercoat layer 30 is improved, and the dye is less likely to be diffused in the primer layer 20 or the undercoat layer 30; thus, transfer sensitivity is considered to be improved.

Further, the present inventors found that transfer sensitivity was further improved when the hydroxyl value of the polyurethane-urea resin was adjusted to 10 mgKOH/g or more and 30 mgKOH/g or less.

This is considered to be because the hydroxyl groups of the polyurethane-urea resin interact with the lactam structure part of the polyvinyl pyrrolidone, and react with the glycidyl group in the acrylic-polyester copolymer, thereby further improving the film aggregation force.

If the hydroxyl value exceeds 30 mgKOH/g, the hydrophilicity of the resulting polyurethane-urea resin is increased, and the polyurethane-urea resin is eroded during lamination of the undercoat layer 30; therefore, adhesion tends to be reduced.

If the primer layer 20 is used alone without providing the undercoat layer 30, adhesion to the dye layer 40 is poor, and transfer sensitivity is significantly reduced.

Moreover, the undercoat layer coating liquid and the primer layer coating liquid are poorly compatible with each other, and cannot be used in a mixed form.

The polyurethane-urea resin according to the present embodiment can be obtained by the reaction of an organic diisocyanate, a polymer diol, and an amine-based chain extender.

The method for producing the polyurethane-urea resin according to the present embodiment is not particularly limited; for example, a two-step method is generally known, in which a prepolymer having an isocyanate group on both ends of a polymer polyol is prepared by the reaction of a compound having one or more polymer diols and one or more isocyanate groups, and optionally a diisocyanate compound, at a ratio in which the isocyanate groups are excess, and the prepolymer is then reacted with a chain extender in a suitable solvent, and optionally further reacted with a reaction terminator.

[Organic Polyisocyanate]

The organic polyisocyanate used to obtain a polyurethane-urea resin is not particularly limited; however, in consideration of the adhesion of the primer layer 20 to the substrate 10 and the undercoat layer 30, aromatic diisocyanates and alicyclic diisocyanates are preferable. Specific examples thereof include tolylene diisocyanate, naphthalene diisocyanate, xylene diisocyanate, diphenylmethane diisocyanate, dicyclohexylmethane diisocyanate, isophorone diisocyanate, and norbornane diisocyanate; these can be used singly or in combination of two or more.

[Polymer Polyol]

The polymer polyol used to obtain a polyurethane-urea resin is suitably determined in consideration of heat resistance, solubility, drying property, adhesion, etc.; however, in general, the number average molecular weight thereof is preferably within a range of 500 or more and 5000 or less, and more preferably 1000 or more and 3000 or less.

When the molecular weight is less than 500, heat resistance and printability tend to be inferior, whereas when the molecular weight exceeds 5000, adhesion tends to be reduced.

Examples of the polymer polyol include polyester polyol, polyether polyol, polycarbonate polyol, polycaprolactam polyol, and polyolefin polyol. These polymer polyols may be used singly or in combination of two or more. In the present embodiment, it is essential to use at least polycarbonate polyol and polycaprolactam polyol, in terms of heat resistance, flexibility, alcohol resistance, and water resistance.

[Amine-Based Chain Extender]

Examples of the amine-based chain extender used to obtain a polyurethane-urea resin include aliphatic diamines, alicyclic diamines, heterocyclic diamines, and the like that have two amino groups per molecule. Preferable among these are diamines having one or more hydroxyl groups per molecule. In particular, alkanolamines having 1 to 4 hydroxyl groups per molecule are preferable; however, a hydroxyl group-containing diamine can be used in combination with a diamine that does not contain a hydroxyl group, as long as the present embodiment is not impaired.

Examples of the amine-based chain extender include ethylenediamine, propylenediamine, trimethylenediamine, butylenediamine, hexamethylenediamine, isophoronediamine, 1,3-cyclohexylenediamine, 4,4'-diaminodiphenylmethane, tolylenediamine, phenylenediamine, xylenediamine, piperazine, 1,4-diaminopiperazine, 2-hydroxyethyl ethylenediamine, 2-hydroxyethyl propylenediamine, N,N'-di-2-hydroxyethyl ethylenediamine, N,N'-di-2-hydroxyethyl propylenediamine, 2-hydroxypropyl ethylenediamine, N,N'-di-2-hydroxypropyl ethylenediamine, 2-hydroxypropanediamine, and the like.

In the polyurethane-urea resin according to the present embodiment, part of the polymer diol may be substituted with low-molecular-weight polyols, such as various low-molecular-weight polyols used in the production of polymer diols, and the amount of low-molecular-weight diol used in this case is 20 mass % or less, and preferably 10 mass % or less.

If the amount of low-molecular-weight polyols used exceeds 20 mass %, adhesion to the substrate 10 is reduced, and transfer sensitivity is also reduced.

As the polyisocyanate according to the present embodiment, a compound having two or more isocyanate groups per molecule can be suitably used. Examples of the polyisocyanate include aromatic polyisocyanates, such as tolylene diisocyanate; alicyclic polyisocyanates, such as isophorone diisocyanate; aliphatic polyisocyanates, such as hexamethylene diisocyanate; modified polyisocyanates, such as adducts, biurets, and isocyanurates of the above polyisocyanates; and the like.

Particularly in terms of transfer sensitivity and adhesion, the polyisocyanate according to the present embodiment is preferably a polyisocyanate selected from diphenylmethane diisocyanate, tolylene diisocyanate, or xylene diisocyanate.

Commercially available polyisocyanates can be used, and examples thereof include Takenate D-101E, D-103H, D-103M-2, D-268, D-110N, D-268, and D-204 (all of which are produced by Mitsui Chemicals, Inc.), Burnock D-750, D-800, and DN-950 (produced by DIC Corporation), Coronate 2030, 2031, 2037, and 2071, Coronate L, HX, HK, and HL (produced by Tosoh Corporation), and the like.

The coating amount of the primer layer 20 after drying is not generally limited, but is preferably within a range of 0.03 $g/m^2$ or more and 0.25 $g/m^2$ or less.

If the coating amount of the primer layer 20 after drying is less than 0.03 g/m$^2$, transfer sensitivity is not improved, and sufficient adhesion cannot be ensured.

In contrast, if the coating amount of the primer layer 20 after drying is more than 0.25 g/m$^2$, the sensitivity of the thermal transfer recording medium 1 itself is not changed, and the printing density is saturated. Therefore, the coating amount of the primer layer 20 after drying is preferably 0.25 g/m$^2$ or less, in terms of cost.

(Dye Layer 40)

The dye layer 40 is formed by, for example, preparing a coating liquid for forming the dye layer 40 by mixing a thermal transfer dye, a binder resin, a solvent, etc., and applying the coating liquid, followed by drying. The coating amount of the dye layer 40 after drying is suitably about 1.0 g/m$^2$. The dye layer 40 can be formed from a single monochrome layer, or a plurality of layers containing dyes having different hues can be repeatedly formed sequentially on the same surface of the same substrate 10.

The thermal transfer dye contained in the dye layer 40 is not particularly limited, and any dye can be used as long as it is molten, diffused, or sublimation-transferred by heat.

Examples of color components of the thermal transfer dye include a cyan component, a magenta component, a yellow component, and a black component (CMYK).

Examples of the cyan component include C. I. Disperse Blue 354, C.I. Solvent Blue 63, C.I. Solvent Blue 36, C.I. Disperse Blue 24, and the like.

Moreover, examples of the magenta component include C. I. Disperse Red 60, C.I. Disperse Violet 26, C.I. Solvent Red 27, C.I. Solvent Red 19, and the like.

Moreover, examples of the yellow component include Solvent Yellow 56, 16, 30, 93, and 33; Disperse Yellow 201, 231, and 33; and the like.

Examples of the black component include carbon black (Pigment Black 7), Indian ink, and the like. The black component can also be toned by combining the above dyes (the cyan component, the magenta component, and the yellow component).

Examples of the binder resin contained in the dye layer 40 include cellulose resins, such as ethyl cellulose, hydroxyethyl cellulose, ethylhydroxy cellulose, hydroxypropyl cellulose, methylcellulose, and cellulose acetate; vinyl resins, such as polyvinyl alcohol, polyvinyl acetate, polyvinyl butyral, polyvinyl acetal, polyvinyl pyrrolidone, and polyacrylamide; polyester resins, styrene-acrylonitrile copolymer resins, phenoxy resins, and the like. However, the binder resin contained in the dye layer 40 is not particularly limited.

Here, the mixing ratio of dye and binder (dye/binder) in the dye layer 40 is preferably within a range of 10/100 to 300/100 on a mass basis.

This is because if the mixing ratio of dye and binder in the dye layer 40 is less than 10/100, the amount of dye is too low to obtain sufficient coloring sensitivity, and an excellent thermal transfer image cannot be obtained.

This is also because if the mixing ratio of dye and binder in the dye layer 40 exceeds 300/100, the solubility of the dye in the binder is extremely reduced; thus, storage stability is deteriorated when the thermal transfer recording medium 1 is formed, and the dye is likely to be deposited.

Furthermore, the dye layer 40 may contain additives, such as isocyanate compounds, silane coupling agents, dispersants, viscosity modifiers, and stabilizers, within a range that does not impair its performance.

(Heat-Resistant Lubricating Layer 50)

The heat-resistant lubricating layer 50 is formed by, for example, preparing a coating liquid for forming the heat-resistant lubricating layer by mixing a binder resin, a functional additive that imparts releasability and sliding properties, a filler, a curing agent, a solvent, etc., and applying the coating liquid, followed by drying. The coating amount of the heat-resistant lubricating layer 50 after drying is suitably within a range of 0.1 g/m$^2$ or more and 2.0 g/m$^2$ or less.

Examples of the binder resin contained in the heat-resistant lubricating layer 50 include polyvinyl butyral resins, polyvinyl acetoacetal resins, polyester resins, vinyl chloride-vinyl acetate copolymers, polyether resins, polybutadiene resins, acrylic polyol, polyurethane acrylate, polyester acrylate, polyether acrylate, epoxy acrylate, nitrocellulose resins, cellulose acetate resins, polyamide resins, polyimide resins, polyamide-imide resins, polycarbonate resins, and the like.

Moreover, examples of the functional additive contained in the heat-resistant lubricating layer 50 include surfactants, including natural wax, such as animal wax and plant wax; synthetic wax, such as synthetic hydrocarbon wax, aliphatic alcohol and acid wax, fatty acid ester and glycerite wax, synthetic ketone wax, amine and amide wax, chlorinated hydrocarbon wax, and alpha olefin wax; higher fatty acid esters, such as butyl stearate and ethyl oleate; higher fatty acid metal salts, such as sodium stearate, zinc stearate, calcium stearate, potassium stearate, and magnesium stearate; phosphate esters, such as long-chain alkyl phosphate ester, polyoxyalkylene alkylaryl ether phosphate ester, and polyoxyalkylene alkylether phosphate ester; and the like.

Moreover, examples of the filler contained in the heat-resistant lubricating layer 50 include talc, silica, magnesium oxide, zinc oxide, calcium carbonate, magnesium carbonate, kaolin, clay, silicone particles, polyethylene resin particles, polypropylene resin particles, polystyrene resin particles, polymethyl methacrylate resin particles, polyurethane resin particles, and the like.

Moreover, examples of the curing agent contained in the heat-resistant lubricating layer 50 include, but are not particularly limited to, tolylene diisocyanate, triphenylmethane triisocyanate, tetramethylxylene diisocyanate, and like isocyanates, as well as derivatives thereof.

(Working Effects)

(1) The thermal transfer recording medium 1 according to the present embodiment has a structure comprising a primer layer 20, an undercoat layer 30, and a dye layer 40 in this order on one surface of a substrate 10, and a heat-resistant lubricating layer 50 on the other surface of the substrate 10; wherein the primer layer 20 contains polycarbonate and a polyurethane-urea resin having a polycaprolactam skeleton, and the undercoat layer 30 contains a copolymer of polyester and acrylic (a polyester-acrylic copolymer), and polyvinyl pyrrolidone. The polyester-acrylic copolymer is a copolymer of polyester having a sulfonic acid group in a side chain, and acrylic having at least one of a glycidyl group and a carboxyl group.

According to this structure, even when a thermal transfer image-receiving sheet in which a water-based receiving layer is formed (a water-based thermal transfer image-receiving sheet) is used, the occurrence of abnormal transfer can be suppressed, and transfer sensitivity during high-speed printing can be enhanced without increasing the amount of dye used in the dye layer 40.

(2) The primer layer 20 preferably contains polycarbonate, a polyurethane-urea resin having a polycaprolactam skeleton, and a polyisocyanate.

According to this structure, the occurrence of abnormal transfer can be suppressed even after storage in a high-temperature and high-humidity environment, and transfer sensitivity during high-speed printing can be enhanced without increasing the amount of dye used in the dye layer 40.

(3) The polyisocyanate contained in the primer layer 20 is preferably at least one selected from the group consisting of diphenylmethane diisocyanate, tolylene diisocyanate, and xylene diisocyanate.

According to this structure, the adhesion between the substrate 10, the primer layer, the undercoat layer 30, and the dye layer 40 is improved, and the film aggregation force of the primer layer 20 and the undercoat layer 30 is also improved; thus, transfer sensitivity can be enhanced more effectively.

(4) Moreover, in the thermal transfer recording medium 1 according to the present embodiment, the hydroxyl value of the polyurethane-urea resin contained in the primer layer 20 is set to 10 mgKOH/g or more and 30 mgKOH/g or less.

According to this structure, the film aggregation force of the primer layer 20 and the undercoat layer 30 is improved; thus, transfer sensitivity can be enhanced more effectively.

(5) Moreover, in the thermal transfer recording medium 1 according to the present embodiment, the composition ratio of the polyester-acrylic copolymer and the polyvinyl pyrrolidone contained in the undercoat layer 30 is set within a range of 70:30 to 20:80 by mass ratio.

According to this structure, the printing density during high-speed printing can be further increased, and the occurrence of abnormal transfer can be suppressed.

(6) Moreover, in the thermal transfer recording medium 1 according to the present embodiment, the undercoat layer 30 is formed by applying an undercoat layer coating liquid to the primer layer 20, followed by drying, and the coating amount of the undercoat layer 30 after drying is set within a range of 0.03 $g/m^2$ or more and 0.35 $g/m^2$ or less.

(7) Moreover, in the thermal transfer recording medium 1 according to the present embodiment, the primer layer 20 is formed by applying a primer layer coating liquid to the substrate 10, followed by drying, and the coating amount of the primer layer 20 after drying is set within a range of 0.03 $g/m^2$ or more and 0.25 $g/m^2$ or less.

According to this structure, the adhesion between the substrate 10 and the primer layer 20, or the adhesion between the dye layer 40 and the undercoat layer 30 can be increased, and sufficient printing density can be maintained even during high-speed printing. Furthermore, the increase in production costs for thermal transfer recording media can be suppressed.

(Primer Layer Coating Liquid)

Here, the primer layer coating liquid for forming the primer layer 20 described above is explained below.

The primer layer coating liquid used in the present embodiment contains polycarbonate and a polyurethane-urea resin having a polycaprolactam skeleton.

In particular, the primer layer coating liquid is preferably one containing a polyisocyanate, in addition to polycarbonate and a polyurethane-urea resin having a polycaprolactam skeleton. The polyisocyanate in the primer layer coating liquid is preferably selected from diphenylmethane diisocyanate, tolylene diisocyanate, or xylene diisocyanate.

Moreover, the hydroxyl value of the polyurethane-urea resin in the primer layer coating liquid is preferably 10 mgKOH/g or more and 30 mgKOH/g or less.

(Undercoat Layer Coating Liquid)

The undercoat layer coating liquid for forming the undercoat layer 30 described above is explained below.

The undercoat layer coating liquid used in the present embodiment contains a copolymer of polyester and acrylic (a polyester-acrylic copolymer) and polyvinyl pyrrolidone. The polyester-acrylic copolymer is a copolymer of polyester having a sulfonic acid group in a side chain, and acrylic having at least one of a glycidyl group and a carboxyl group.

Moreover, the composition ratio of the polyester-acrylic copolymer and the polyvinyl pyrrolidone in the undercoat layer coating liquid is preferably within a range of 70:30 to 20:80 by mass ratio.

In the case of the thermal transfer recording medium 1 comprising the primer layer 20 formed using the primer layer coating liquid, and the undercoat layer 30 formed using the undercoat layer coating liquid, when an image is formed using a thermal transfer image-receiving sheet in which a water-based receiving layer is formed, the occurrence of abnormal transfer can be suppressed, and transfer sensitivity during high-speed printing can be enhanced without increasing the amount of dye used in the dye layer 40. In particular, when the primer layer 20 contains a polyisocyanate, the occurrence of abnormal transfer can be suppressed even after storage in a high-temperature and high-humidity environment, and transfer sensitivity during high-speed printing can be enhanced without increasing the amount of dye used in the dye layer 40.

(Production Method)

The heat-resistant lubricating layer 50, the primer layer 20, the undercoat layer 30, and the dye layer 40 described above can be formed by applying each layer by a general coating method so that they are sequentially laminated, followed by drying. Examples of the method for applying each layer include a gravure coating method, a screen printing method, a spray coating method, and a reverse roll coating method.

EXAMPLES

The materials used in the Examples of the present embodiments and Comparative Examples thereof are shown below. Note that the term "part" in the sentence is on a mass basis unless otherwise specified. Moreover, the present invention is not limited to the following Examples.

[Production of Substrate 10 with Heat-Resistant Lubricating Layer]

A 4.5-μm polyethylene terephthalate film was used as a substrate 10, and a heat-resistant lubricating layer coating liquid having the following composition was applied to one surface of the film by a gravure coating method so that the coating amount after drying was 1.0 $g/m^2$, followed by drying at 100° C. for 1 minute. Thereafter, aging was conducted in a 40° C. environment for one week, thereby obtaining the substrate 10 with a heat-resistant lubricating layer.

[Heat-Resistant Lubricating Layer Coating Liquid]

Acrylic polyol resin: 12.5 parts
Polyoxyalkylene alkylether phosphate: 2.5 parts
Talc: 6.0 parts
2,6-Tolylene diisocyanate prepolymer: 4.0 parts
Toluene: 50.0 parts
Methyl ethyl ketone: 20.0 parts
Ethyl acetate: 5.0 parts

[Method for Producing Sulfonic Acid Group-Containing Polyester/Glycidyl Group-Containing Acrylic Copolymer]

Dimethyl terephthalate (854 parts), 355 parts of 5-sodium sulfoisophthalate, 186 parts of ethylene glycol, 742 parts of diethylene glycol, and 1 part of zinc acetate as a reaction catalyst were placed in a four-necked flask equipped with a distillation tube, a nitrogen-introducing tube, a thermometer, and a stirrer.

Subsequently, they were heated from 130° C. to 170° C. over 2 hours, 1 part of antimony trioxide was added, then the temperature was raised from 170° C. to 200° C. over 2 hours, and an esterification reaction was carried out. Thereafter, the temperature was gradually raised and the pressure was gradually reduced; finally, a polycondensation reaction was carried out for 1 to 2 hours at a reaction temperature of 250° C. at a degree of vacuum of 1 mmHg or less, thereby obtaining polyester. The obtained polyester was dissolved in pure water, then glycidyl methacrylate was added as a glycidyl group-containing acrylic monomer so that the mass ratio of the polyester to the acrylic monomer was 30:70, and potassium persulfate was further added as a polymerization initiator, thereby producing a monomer emulsion.

Subsequently, pure water and the monomer emulsion were placed in a reaction vessel equipped with a condenser tube, and nitrogen gas was blown for 20 minutes to sufficiently remove oxygen. Thereafter, the pure water and the monomer emulsion were gradually heated over 1 hour, and the reaction was performed for 3 hours while maintaining the temperature at 75° C. or more and 85° C. or less, thereby obtaining a sulfonic acid group-containing polyester/glycidyl group-containing acrylic copolymer.

[Method for Producing Polyurethane-Urea Resin]

Polycarbonate diol (656 parts) having a number average molecular weight of 2000, which was obtained by subjecting 1,6-hexanediol and diethyl carbonate to ethanol elimination, and 300 parts of difunctional polycaprolactone diol having a number average molecular weight of 1000, which was obtained by subjecting 1,4-butanediol and ε-caprolactone to a ring opening addition reaction, were placed in a four-necked flask equipped with a distillation tube, a nitrogen-introducing tube, a thermometer, and a stirrer, nitrogen gas was bubbled while stirring them, and transesterification was performed at 190° C. for 24 hours, thereby obtaining a polyol in a liquid state at ordinary temperature. The hydroxyl group content of the polyol measured by the method according to JIS K1557 was 58 mgKOH/g.

Subsequently, 243 parts of polyol and 46.5 parts of isophorone diisocyanate were placed in a four-necked flask equipped with a distillation tube, a nitrogen-introducing tube, a thermometer, and a stirrer, and reacted under nitrogen flow at 85° C. for 6 hours to obtain a urethane prepolymer. Then, 350 parts of ethyl acetate was added, and the temperature was lowered to 40° C. Subsequently, 350 parts of isopropyl alcohol, 8.35 parts of isophorone diamine, 0.176 parts of di-n-butylamine, and 1.30 parts of 2-amino-2-hydroxymethyl-1,3-propanediol were added, and the mixture was reacted while stirring at 40° C. for 5 hours, thereby obtaining polycarbonate and a polyurethane-urea resin (A-1) having a polycaprolactam skeleton.

The hydroxyl value in this case was 10 mgKOH/g.

A urethane prepolymer was obtained in the same manner by placing 247.6 parts of polyol and 42.6 parts of isophorone diisocyanate, and reacting them under nitrogen flow at 85° C. for 6 hours. Then, 350 parts of ethyl acetate was added, and the temperature was lowered to 40° C. Subsequently, 350 parts of isopropyl alcohol, 5.96 parts of isophorone diamine, and 3.24 parts of 2-amino-2-hydroxymethyl-1,3-propanediol were added, and the mixture was reacted while stirring at 40° C. for 5 hours, thereby obtaining polycarbonate and a polyurethane-urea resin (A-2) having a polycaprolactam skeleton.

The hydroxyl value in this case was 30 mgKOH/g.

A urethane prepolymer was obtained in the same manner by placing 247 parts of polyol and 42.5 parts of isophorone diisocyanate, and reacting them under nitrogen flow at 85° C. for 6 hours. Then, 350 parts of ethyl acetate was added, and the temperature was lowered to 40° C. Subsequently, 350 parts of isopropyl alcohol, 8.35 parts of isophorone diamine, 0.18 parts of di-n-butylamine, 1.30 parts of 2-amino-2-hydroxymethyl-1,3-propanediol were added, and the mixture was reacted while stirring at 40° C. for 5 hours, thereby obtaining polycarbonate and a polyurethane-urea resin (A-3) having a polycaprolactam skeleton.

The hydroxyl value in this case was 5 mgKOH/g.

A urethane prepolymer was obtained in the same manner by placing 247.6 parts of polyol and 42.6 parts of isophorone diisocyanate, and reacting them under nitrogen flow at 85° C. for 6 hours. Then, 350 parts of ethyl acetate was added, and the temperature was lowered to 40° C. Subsequently, 350 parts of isopropyl alcohol, 5.96 parts of isophorone diamine, and 4.10 parts of 2-amino-2-hydroxymethyl-1,3-propanediol were added, and the mixture was reacted while stirring at 40° C. for 5 hours, thereby obtaining polycarbonate and a polyurethane-urea resin (A-4) having a polycaprolactam skeleton.

The hydroxyl value in this case was 40 mgKOH/g.

A urethane prepolymer was obtained by placing 245 parts of polycondensate of adipic acid and 3-methyl-1,5-pentanediol (hydroxyl value: 56.1 mgKOH/g) and 46.5 parts of isophorone diisocyanate in a four-necked flask equipped with a distillation tube, a nitrogen-introducing tube, a thermometer, and a stirrer, and reacting them under nitrogen flow at 85° C. for 6 hours. Then, 350 parts of ethyl acetate was added, and the temperature was lowered to 40° C. Subsequently, 350 parts of isopropyl alcohol, 5.96 parts of isophorone diamine, and 4.24 parts of 2-amino-2-hydroxymethyl-1,3-propanediol were added, and the mixture was reacted while stirring at 40° C. for 5 hours, thereby obtaining a polyurethane-urea resin (A-5) not having a polycaprolactam skeleton.

The hydroxyl value in this case was 10 mgKOH/g.

First Examples

First of all, First Examples are explained.

Example 1

A primer layer coating liquid-1 having the following composition was applied to the surface of the substrate 10 with a heat-resistant lubricating layer, to which the heat-resistant lubricating layer was not applied, by a gravure coating method so that the coating amount after drying was 0.10 g/m$^2$, followed by drying at 100° C. for 2 minutes, thereby forming a primer layer 20.

Subsequently, an undercoat layer coating liquid-1 having the following composition was applied by a gravure coating method so that the coating amount after drying was 0.20 g/m$^2$, followed by drying at 100° C. for 2 minutes, thereby forming an undercoat layer 30.

Further, a dye layer coating liquid-1 having the following composition was applied to the undercoat layer 30 by a gravure coating method so that the coating amount after drying was 0.70 g/m$^2$, followed by drying at 90° C. for 1 minute, thereby forming a dye layer 40.

Thus, a thermal transfer recording medium of Example 1 was obtained.

[Primer Layer Coating Liquid-1]
Polyurethane-urea resin (A-1): 2.00 parts
Methyl ethyl ketone: 50.0 parts
Toluene: 0.0 parts
Isopropyl alcohol: 18.0 parts
[Undercoat Layer Coating Liquid-1]
Sulfonic acid group-containing polyester/
glycidyl group-containing acrylic copolymer (30:70): 2.50 parts
Polyvinyl pyrrolidone (K value: 60): 2.50 parts
Pure water: 57.0 parts
Isopropyl alcohol: 38.0 parts
[Dye Layer Coating Liquid-1]
C. I. Solvent Blue-63: 6.0 parts
Polyvinyl acetal resin: 4.0 parts
Toluene: 45.0 parts
Methyl ethyl ketone: 45.0 parts Example 2

A thermal transfer recording medium of Example 2 was obtained in the same manner as in Example 1, except that the undercoat layer 30 was formed using an undercoat layer coating liquid-2 having the following composition in the thermal transfer recording medium produced in Example 1.
[Undercoat Layer Coating Liquid-2]
Sulfonic acid group-containing polyester/carboxyl group-containing acrylic copolymer (30:70): 2.50 parts
Polyvinyl pyrrolidone (K value: 60): 2.50 parts
Pure water: 57.0 parts
Isopropyl alcohol: 38.0 parts Example 3

A thermal transfer recording medium of Example 3 was obtained in the same manner as in Example 1, except that the undercoat layer 30 was formed using an undercoat layer coating liquid-3 having the following composition in the thermal transfer recording medium produced in Example 1.
[Undercoat Layer Coating Liquid-3]
Sulfonic acid group-containing polyester/
glycidyl group-containing acrylic copolymer (30:70): 1.00 part
Polyvinyl pyrrolidone (K value: 60): 4.00 parts
Pure water: 57.0 parts
Isopropyl alcohol: 38.0 parts Example 4

A thermal transfer recording medium of Example 4 was obtained in the same manner as in Example 1, except that the undercoat layer 30 was formed using an undercoat layer coating liquid-4 having the following composition in the thermal transfer recording medium produced in Example 1.
[Undercoat Layer Coating Liquid-4]
Sulfonic acid group-containing polyester/
glycidyl group-containing acrylic copolymer (30:70): 3.50 parts
Polyvinyl pyrrolidone (K value: 60): 1.50 parts
Pure water: 57.0 parts
Isopropyl alcohol: 38.0 parts Example 5

A thermal transfer recording medium of Example 5 was obtained in the same manner as in Example 1, except that the primer layer coating liquid was changed to a primer layer coating liquid-2 having the following composition in the thermal transfer recording medium produced in Example 1.
[Primer Layer Coating Liquid-2]
Polyurethane-urea resin (A-2): 2.00 parts
Methyl ethyl ketone: 50.0 parts
Toluene: 30.0 parts
Isopropyl alcohol: 18.0 parts Example 6

A thermal transfer recording medium of Example 6 was obtained in the same manner as in Example 1, except that the primer layer coating liquid was applied so that the coating amount of the primer layer 20 after drying was 0.03 g/m$^2$, followed by drying, in the thermal transfer recording medium produced in Example 1.

Example 7

A thermal transfer recording medium of Example 7 was obtained in the same manner as in Example 1, except that the primer layer coating liquid was applied so that the coating amount of the primer layer 20 after drying was 0.25 g/m$^2$, followed by drying, in the thermal transfer recording medium produced in Example 1.

Example 8

A thermal transfer recording medium of Example 8 was obtained in the same manner as in Example 1, except that the undercoat layer coating liquid was applied so that the coating amount of the undercoat layer 30 after drying was 0.03 g/m$^2$, followed by drying, in the thermal transfer recording medium produced in Example 1.

Example 9

A thermal transfer recording medium of Example 9 was obtained in the same manner as in Example 1, except that the undercoat layer coating liquid was applied so that the coating amount of the undercoat layer 30 after drying was 0.35 g/m$^2$, followed by drying, in the thermal transfer recording medium produced in Example 1.

Comparative Example 1

The primer layer 20 and the undercoat layer 30 were not formed, and the same dye layer coating liquid as that of Example 1 was applied to the surface of the substrate 10 with a heat-resistant lubricating layer, to which the heat-resistant lubricating layer was not applied, by a gravure coating method so that the coating amount after drying was 0.7 g/m$^2$, followed by drying, thereby forming a dye layer 40. Thus, a thermal transfer recording medium of Comparative Example 1 was obtained.

Comparative Example 2

A thermal transfer recording medium of Comparative Example 2 was obtained in the same manner as in Example 1, without forming the primer layer 20 in the thermal transfer recording medium produced in Example 1.

Comparative Example 3

A thermal transfer recording medium of Comparative Example 3 was obtained in the same manner as in Example 1, without forming the undercoat layer 30 in the thermal transfer recording medium produced in Example 1.

Comparative Example 4

A thermal transfer recording medium of Comparative Example 4 was obtained in the same manner as in Example 1, except that the primer layer 20 was formed using a primer layer coating liquid-3 having the following composition.

[Primer Layer Coating Liquid-3]
Polyurethane-urea resin (A-3): 2.00 parts
Methyl ethyl ketone: 50.0 parts
Toluene: 30.0 parts
Isopropyl alcohol: 18.0 parts Comparative Example 5

A thermal transfer recording medium of Comparative Example 5 was obtained in the same manner as in Example 1, except that the primer layer 20 was formed using a primer layer coating liquid-4 having the following composition.

[Primer Layer Coating Liquid-4]
Polyurethane-urea resin (A-4): 2.00 parts
Methyl ethyl ketone: 50.0 parts
Toluene: 30.0 parts
Isopropyl alcohol: 18.0 parts Comparative Example 6

A thermal transfer recording medium of Comparative Example 6 was obtained in the same manner as in Example 1, except that the primer layer 20 was formed using a primer layer coating liquid-5 (a polyurethane-urea resin not having a caprolactam skeleton) having the following composition.

[Primer Layer Coating Liquid-5]
Polyurethane-urea resin (A-5): 2.00 parts
Methyl ethyl ketone: 50.0 parts
Toluene: 30.0 parts
Isopropyl alcohol: 18.0 parts Comparative Example 7

A thermal transfer recording medium of Comparative Example 7 was obtained in the same manner as in Example 1, except that the undercoat layer 30 was formed using an undercoat layer coating liquid-5 having the following composition.

[Undercoat Layer Coating Liquid-5]
Sulfonic acid group-containing polyester/
glycidyl group-containing acrylic copolymer (30:70): 0.50 parts
Polyvinyl pyrrolidone (K value: 60): 4.50 parts
Pure water: 57.0 parts
Isopropyl alcohol: 38.0 parts Comparative Example 8

A thermal transfer recording medium of Comparative Example 8 was obtained in the same manner as in Example 1, except that the undercoat layer 30 was formed using a coating liquid-6 for the undercoat layer 30 having the following composition.

[Undercoat Layer Coating Liquid-6]
Sulfonic acid group-containing polyester/
glycidyl group-containing acrylic copolymer (30:70): 4.00 parts
Polyvinyl pyrrolidone (K value: 60): 1.00 part
Pure water: 57.0 parts
Isopropyl alcohol: 38.0 parts Comparative Example 9

A thermal transfer recording medium of Comparative Example 9 was obtained in the same manner as in Example 1, except that the undercoat layer 30 was formed using an undercoat layer coating liquid-7 having the following composition.

[Undercoat Layer Coating Liquid-7]
Polyvinyl pyrrolidone (K value: 60): 5.00 parts
Pure water: 57.0 parts
Isopropyl alcohol: 38.0 parts Comparative Example 10

A thermal transfer recording medium of Comparative Example 10 was obtained in the same manner as in Example 1, except that the undercoat layer 30 was formed using an undercoat layer coating liquid-8 having the following composition in the thermal transfer recording medium produced in Example 1.

[Undercoat Layer Coating Liquid-8]
Sulfonic acid group-containing polyester resin: 10.0 parts
Pure water: 45.0 parts
Isopropyl alcohol: 45.0 parts Comparative Example 11

A thermal transfer recording medium of Comparative Example 11 was obtained in the same manner as in Example 1, except that the undercoat layer 30 was formed using an undercoat layer coating liquid-9 having the following composition in the thermal transfer recording medium produced in Example 1.

[Undercoat Layer Coating Liquid-9]
Glycidyl group-containing acrylic resin: 10.0 parts
Pure water: 45.0 parts
Isopropyl alcohol: 45.0 parts Comparative Example 12

A thermal transfer recording medium of Comparative Example 12 was obtained in the same manner as in Example 1, except that the undercoat layer 30 was formed using an undercoat layer coating liquid-10 having the following composition.

[Undercoat Layer Coating Liquid-10]
Sulfonic acid group-containing polyester/
glycidyl group-containing acrylic copolymer (30:70): 5.00 parts
Pure water: 57.0 parts
Isopropyl alcohol: 38.0 parts Comparative Example 13

A thermal transfer recording medium of Comparative Example 13 was obtained in the same manner as in Example 1, except that the undercoat layer 30 was formed using an undercoat layer coating liquid-11 having the following composition in the thermal transfer recording medium produced in Example 1.

[Undercoat Layer Coating Liquid-11]
Glycidyl group-containing acrylic resin: 7.00 parts
Sulfonic acid group-containing polyester resin: 3.00 parts
Pure water: 45.0 parts
Isopropyl alcohol: 45.0 parts Comparative Example 14

A thermal transfer recording medium of Comparative Example 14 was obtained in the same manner as in Example 1, except that the primer layer coating liquid was applied so that the coating amount of the primer layer 20 after drying was 0.01 g/m$^2$, followed by drying, in the thermal transfer recording medium produced in Example 1.

Comparative Example 15

A thermal transfer recording medium of Comparative Example 15 was obtained in the same manner as in Example 1, except that the primer layer coating liquid was applied so that the coating amount of the primer layer 20 after drying was 0.30 g/m$^2$, followed by drying, in the thermal transfer recording medium produced in Example 1.

Comparative Example 16

A thermal transfer recording medium of Comparative Example 16 was obtained in the same manner as in Example 1, except that the undercoat layer coating liquid was applied so that the coating amount of the undercoat layer 30 after drying was 0.01 g/m$^2$, followed by drying, in the thermal transfer recording medium produced in Example 1.

Comparative Example 17

A thermal transfer recording medium of Comparative Example 17 was obtained in the same manner as in Example 1, except that the undercoat layer coating liquid was applied so that the coating amount of the undercoat layer 30 after drying was 0.40 g/m$^2$, followed by drying, in the thermal transfer recording medium produced in Example 1.

[Production of Transfer Object]

(1) Production of Solvent-Based Thermal Transfer Image-Receiving Sheet

A 188-μm white foamed polyethylene terephthalate film was used as a substrate 10, and an image-receiving layer coating liquid having the following composition was applied to one surface of the film by a gravure coating method so that the coating amount after drying was 5.0 g/m$^2$, followed by drying. Thus, a transfer object for thermal transfer was produced.

[Image-Receiving Layer Coating Liquid]

Vinyl chloride-vinyl acetate-vinyl alcohol copolymer: 19.5 parts

Amino-modified silicone oil: 0.5 parts

Toluene: 40.0 parts

Methyl ethyl ketone: 40.0 parts (2) Production of Water-Based Thermal Transfer Image-Receiving Sheet

[Preparation of Image Receiver Substrate]

Art paper having a thickness of 180 g/m$^2$ was used as an image receiver substrate.

[Formation of Hollow Particle Layer]

A hollow particle layer coating liquid having the following composition was applied to the image receiver substrate by a gravure coating method so that the coating amount after drying was 10 g/m$^2$, and then dried, followed by aging in a 40° C. environment for one week, thereby obtaining an image receiver with a hollow particle layer.

[Hollow Particle Layer Coating Liquid]

Foamed hollow particles containing a copolymer comprising acrylonitrile and methacrylonitrile as main components: 45 parts (average particle diameter: 3.2 μm, volume hollow ratio: 85%)

Polyvinyl alcohol: 10 parts

Vinyl chloride-vinyl acetate copolymer resin dispersion: 45 parts (vinyl chloride/vinyl acetate=70/30, Tg: 64° C.)

Water: 200 parts

[Formation of Receiving Layer]

A receiving layer coating liquid having the following composition was applied to a heat insulating layer by a gravure coating method so that the coating amount after drying was 4 g/m2, and then dried, followed by aging in a 40° C. environment for one week, thereby obtaining a receiving layer.

[Receiving Layer Coating Liquid]

Vinyl chloride-vinyl acetate copolymer resin dispersion: 80 parts (e.g., Vinyblan 900, produced by Nissin Chemical Industry Co., Ltd.)

Polyether-modified silicone: 10 parts (e.g., KF615A, produced by Shin-Etsu Chemical Co., Ltd.)

Water: 400 parts

[Printing Evaluation]

Using the thermal transfer recording media of Examples 1 to 9 and Comparative Examples 1 to 17, solid printing was conducted by a thermal simulator, and the maximum reflection density was evaluated. Table 1 shows the results. Note that the maximum reflection density is a value measured by X-Rite 528.

The printing conditions are as follows.

Printing environment: 23° C. 50% RH

Applied voltage: 29 V

Line cycle: 0.9 msec

Printing density: main scanning 300 dpi, sub-scanning 300 dpi

[Evaluation of Abnormal Transfer]

Regarding the thermal transfer recording media of Examples 1 to 9 and Comparative Examples 1 to 17, solid printing was conducted by a thermal simulator in a 40° C. 90% environment using the thermal transfer recording media aged at ordinary temperature and the transfer objects; and the presence of abnormal transfer was evaluated. Table 1 shows the results.

Abnormal transfer was evaluated on the basis of the following criteria. "No abnormal transfer" and "Slight abnormal transfer" are levels that do not cause any practical problems.

No abnormal transfer: abnormal transfer to the transfer object was not observed.

Slight abnormal transfer: abnormal transfer to the transfer object was slightly observed.

Partial abnormal transfer: abnormal transfer to the transfer object was partially observed.

Entire abnormal transfer: abnormal transfer to the transfer object was observed on the entire surface.

TABLE 1

| | Coating amount of primer layer after drying [g/m $^2$] | Polyurethane-urea resin Hydroxyl value (mgKOH/g) | Coating amount of undercoat layer after drying [g/m2] | Polyester-acrylic copolymerization ratio (weight ratio) (A) | | |
|---|---|---|---|---|---|---|
| | | | | Sulfonic acid group-containing polyester | Glycidyl group-containing acrylic | Carboxyl group-containing acrylic |
| Example 1 | 0.10 | 10 | 0.20 | 30 | 70 | — |
| Example 2 | 0.10 | 10 | 0.20 | 30 | — | 70 |
| Example 3 | 0.10 | 10 | 0.20 | 30 | 70 | — |
| Example 4 | 0.10 | 10 | 0.20 | 30 | 70 | — |
| Example 5 | 0.10 | 30 | 0.20 | 30 | 70 | — |
| Example 6 | 0.03 | 10 | 0.20 | 30 | 70 | — |
| Example 7 | 0.25 | 10 | 0.20 | 30 | 70 | — |
| Example 8 | 0.10 | 10 | 0.03 | 30 | 70 | — |
| Example 9 | 0.10 | 10 | 0.35 | 30 | 70 | — |
| Comparative Example 1 | — | — | — | — | — | — |
| Comparative Example 2 | — | — | 0.20 | 30 | 70 | — |
| Comparative Example 3 | 0.10 | 10 | — | — | — | — |
| Comparative Example 4 | 0.10 | 5 | 0.20 | 30 | 70 | — |
| Comparative Example 5 | 0.10 | 40 | 0.20 | 30 | 70 | — |
| Comparative Example 6 | 0.10 | 10 | 0.20 | 30 | 70 | — |
| Comparative Example 7 | 0.10 | 10 | 0.20 | 30 | 70 | — |
| Comparative Example 8 | 0.10 | 10 | 0.20 | 30 | 70 | — |
| Comparative Example 9 | 0.10 | 10 | 0.20 | — | — | — |
| Comparative Example 10 | 0.10 | 10 | 0.20 | 100 | — | — |
| Comparative Example 11 | 0.10 | 10 | 0.20 | — | 100 | — |
| Comparative Example 12 | 0.10 | 10 | 0.20 | 30 | 70 | — |
| Comparative Example 13 | 0.10 | 10 | 0.20 | Polyester/glycidyl group-containing acrylic blend (30/70) | | |
| Comparative Example 14 | 0.01 | 10 | 0.20 | 30 | 70 | — |
| Comparative Example 15 | 0.30 | 10 | 0.20 | 30 | 70 | — |
| Comparative Example 16 | 0.10 | 10 | 0.01 | 30 | 70 | — |
| Comparative Example 17 | 0.10 | 10 | 0.40 | 30 | 70 | — |

| | Polyester-acrylic copolymer:PVP (weight ratio) (B) | Maximum reflection density (255/255) | Abnormal transfer evaluation |
|---|---|---|---|
| Example 1 | 50:50 | 2.59 | No abnormal transfer |
| Example 2 | 50:50 | 2.55 | No abnormal transfer |
| Example 3 | 20:80 | 2.49 | No abnormal transfer |
| Example 4 | 70:30 | 2.61 | No abnormal transfer |
| Example 5 | 50:50 | 2.63 | No abnormal transfer |
| Example 6 | 50:50 | 2.54 | Slight abnormal transfer |
| Example 7 | 50:50 | 2.59 | Slight abnormal transfer |
| Example 8 | 50:50 | 2.53 | Slight abnormal transfer |
| Example 9 | 50:50 | 2.58 | Slight abnormal transfer |
| Comparative Example 1 | — | 1.85 | Entire abnormal transfer |
| Comparative Example 2 | 50:50 | 2.49 | Partial abnormal transfer |
| Comparative Example 3 | — | 1.75 | Entire abnormal transfer |

TABLE 1-continued

| | | | |
|---|---|---|---|
| Comparative Example 4 | 50:50 | 2.56 | Partial abnormal transfer |
| Comparative Example 5 | 50:50 | 2.52 | Partial abnormal transfer |
| Comparative Example 6 | 50:50 | 2.40 | Entire abnormal transfer |
| Comparative Example 7 | 10:90 | 2.35 | Partial abnormal transfer |
| Comparative Example 8 | 80:20 | 2.63 | Partial abnormal transfer |
| Comparative Example 9 | 0:100 | 2.21 | Partial abnormal transfer |
| Comparative Example 10 | — | 1.80 | Partial abnormal transfer |
| Comparative Example 11 | — | 2.45 | Entire abnormal transfer |
| Comparative Example 12 | 100:0 | 2.41 | Entire abnormal transfer |
| Comparative Example 13 | Polyester/glycidyl group-containing acrylic blend (30/70) | 2.05 | Entire abnormal transfer |
| Comparative Example 14 | 50:50 | 2.49 | Partial abnormal transfer |
| Comparative Example 15 | 50:50 | 2.59 | Slight abnormal transfer |
| Comparative Example 16 | 50:50 | 2.45 | Partial abnormal transfer |
| Comparative Example 17 | 50:50 | 2.58 | Slight abnormal transfer |

The results shown in Table 1 revealed that Examples 1 to 5, in which polycarbonate and a polyurethane-urea resin having a polycaprolactam skeleton were used in the primer layer 20, and a polyester-acrylic copolymer and polyvinyl pyrrolidone were used in the undercoat layer 30, showed an improvement in transfer sensitivity and did not undergo abnormal transfer when a water-based thermal transfer image-receiving sheet was used, in comparison to Comparative Examples 1 and 2, in which the primer layer 20 was not provided, and Comparative Example 6, in which polycarbonate and the polyurethane-urea resin (A-5) not having a polycaprolactam skeleton were used in the primer layer 20.

It was also revealed that Comparative Example 12, in which a copolymer of sulfonic acid group-containing polyester and glycidyl group-containing acrylic was used in the undercoat layer 30, had higher transfer sensitivity during high-speed printing, in comparison to Comparative Example 1, in which the undercoat layer 30 was not provided, Comparative Example 10, in which only sulfonic acid group-containing polyester was used, and Comparative Example 13, in which sulfonic acid group-containing polyester and glycidyl group-containing acrylic were simply mixed.

Moreover, when Example 1, in which polyvinyl pyrrolidone was mixed with a polyester-acrylic copolymer, was compared with Comparative Example 9, in which polyvinyl pyrrolidone was used alone, and Comparative Example 12, in which a polyester-acrylic copolymer was used alone, it was confirmed that the maximum reflection density was improved by mixing polyvinyl pyrrolidone. This demonstrated that transfer sensitivity was further increased when polyvinyl pyrrolidone was mixed with a polyester-acrylic copolymer.

Further, there was a tendency that transfer sensitivity was reduced when the ratio of polyvinyl pyrrolidone to the polyester-acrylic copolymer increased (see Examples 1, 3, and 4, and Comparative Examples 7 and 8). There was also a tendency that adhesion was reduced when the ratio of polyvinyl pyrrolidone decreased. These tendencies indicated that the mixing ratio of the polyester-acrylic copolymer and the polyvinyl pyrrolidone was preferably within a range of 70:30 to 20:80 by mass ratio.

Moreover, when Example 1, in which the hydroxyl value of the polyurethane-urea resin used in the primer layer 20 was 10 mg, Example 5, in which the hydroxyl value was 30 mg, and Comparative Example 5, in which the hydroxyl value was 40 mgKOH/g, were compared, there was a tendency that transfer sensitivity and adhesion were reduced. Furthermore, when Example 1, in which the hydroxyl value was 10 mg, and Comparative Example 4, in which the hydroxyl value was 5 mg, were compared, their adhesion was equivalent, but their transfer sensitivity was different. These results demonstrated that the hydroxyl value of the polyurethane-urea resin was preferably less than 40 mgKOH/g, and more preferably within a range of 10 mgKOH/g or more and 30 mgKOH/g or less in terms of transfer sensitivity.

Moreover, in the thermal transfer recording medium of Example 6, the coating amount of the primer layer 20 was 0.03 g/m$^2$; thus, a very slight reduction was confirmed in transfer sensitivity and adhesion, in comparison to the thermal transfer recording medium of Example 1. However, this reduction is a level causing no practical problems.

On the other hand, in the thermal transfer recording medium of Comparative Example 14, the coating amount of the primer layer 20 was 0.01 g/m$^2$; thus, transfer sensitivity was not improved, and adhesion was reduced, in comparison to the thermal transfer recording medium of Example 1. Further, abnormal transfer was confirmed.

Moreover, when the thermal transfer recording medium of Example 7, in which the coating amount of the primer layer 20 was 0.25 g/m$^2$, was similarly compared with the thermal transfer recording medium of Example 1, it was revealed that their transfer sensitivity and their adhesion were almost equivalent.

On the other hand, when the thermal transfer recording medium of Comparative Example 15, in which the coating amount of the primer layer 20 was 0.30 g/m$^2$, was similarly compared with the thermal transfer recording medium of Example 1, transfer sensitivity and adhesion were saturated; this is not preferable in terms of cost.

Moreover, in the thermal transfer recording medium of Example 8, the coating amount of the undercoat layer 30 was 0.03 g/m$^2$; thus, a very slight reduction was confirmed in transfer sensitivity, in comparison to the thermal transfer recording medium of Example 1. However, this reduction is a level causing no practical problems.

On the other hand, in the thermal transfer recording medium of Comparative Example 16, the coating amount of the undercoat layer 30 was 0.01 g/m$^2$; thus, a reduction was confirmed in transfer sensitivity and adhesion, in comparison to the thermal transfer recording medium of Example 1. Further, abnormal transfer was confirmed.

Moreover, when the thermal transfer recording medium of Example 9, in which the coating amount of the undercoat layer 30 was 0.35 g/m$^2$, was similarly compared with the thermal transfer recording medium of Example 1, it was revealed that their transfer sensitivity and their adhesion were almost equivalent.

On the other hand, when the thermal transfer recording medium of Comparative Example 17, in which the coating amount of the undercoat layer 30 was 0.40 g/m$^2$, was similarly compared with the thermal transfer recording medium of Example 1, transfer sensitivity and adhesion were saturated; this is not preferable in terms of cost.

Second Examples

Next, the Second Examples are Explained.

Example 1

A primer layer coating liquid-1 having the following composition was applied to the surface of the substrate 10 with a heat-resistant lubricating layer, to which the heat-resistant lubricating layer was not applied, by a gravure coating method so that the coating amount after drying was 0.10 g/m$^2$, followed by drying at 100° C. for 2 minutes, thereby forming a primer layer 20.

Subsequently, an undercoat layer coating liquid-1 having the following composition was applied by a gravure coating method so that the coating amount after drying was 0.20 g/m$^2$, followed by drying at 100° C. for 2 minutes, thereby forming an undercoat layer 30.

Further, a dye layer coating liquid-1 having the following composition was applied to the undercoat layer 30 by a gravure coating method so that the coating amount after drying was 0.70 g/m2, followed by drying at 90° C. for 1 minute, thereby forming a dye layer 40.

Thus, a thermal transfer recording medium of Example 1 was obtained.

[Primer Layer Coating Liquid-1]
Polyurethane-urea resin: 5.00 parts
(solid content: 30%)
Tolylene diisocyanate: 0.60 parts
(solid content: 75%; D-103H, produced by Mitsui Chemicals, Inc.)
Methyl ethyl ketone: 50.0 parts
Ethyl acetate: 25.0 parts
Toluene: 19.4 parts
[Undercoat Layer Coating Liquid-1]
Sulfonic acid-group containing polyester glycidyl group-containing acrylic copolymer (30:70): 2.50 parts
Polyvinyl pyrrolidone (K value: 60): 2.50 parts
Pure water: 57.0 parts
Isopropyl alcohol: 38.0 parts
[Dye Layer Coating Liquid-1]
C. I. Solvent Blue-63: 6.0 parts
Polyvinyl acetal resin: 4.0 parts
Toluene: 45.0 parts
Methyl ethyl ketone: 45.0 parts

Example 2

A thermal transfer recording medium of Example 2 was obtained in the same manner as in Example 1, except that the primer layer 20 was formed using a primer layer coating liquid-2 having the following composition in the thermal transfer recording medium produced in Example 1.

[Primer Layer Coating Liquid-2]
Polyurethane-urea resin: 5.00 parts
(solid content: 30%)
Xylene diisocyanate: 0.60 parts
(solid content: 75%; D-110N, produced by Mitsui Chemicals, Inc.)
Methyl ethyl ketone: 50.0 parts
Ethyl acetate: 25.0 parts
Toluene: 19.4 parts

Example 3

A thermal transfer recording medium of Example 3 was obtained in the same manner as in Example 1, except that the primer layer 20 was formed using a primer layer coating liquid-3 having the following composition in the thermal transfer recording medium produced in Example 1.

[Primer Layer Coating Liquid-3]
Polyurethane-urea resin: 5.00 parts
(solid content: 30%)
Diphenylmethane diisocyanate: 0.60 parts
(solid content: 71%; D-103M-2, produced by Mitsui Chemicals, Inc.)
Methyl ethyl ketone: 50.0 parts
Ethyl acetate: 25.0 parts
Toluene: 19.4 parts

Example 4

A thermal transfer recording medium of Example 4 was obtained in the same manner as in Example 1, except that the undercoat layer 30 was formed using an undercoat layer coating liquid-2 having the following composition in the thermal transfer recording medium produced in Example 1.

[Undercoat Layer Coating Liquid-2]
Sulfonic acid group-containing polyester
carboxyl group-containing acrylic copolymer (30:70): 2.50 parts
Polyvinyl pyrrolidone (K value: 60): 2.50 parts
Pure water: 57.0 parts
Isopropyl alcohol: 38.0 parts

Example 5

A thermal transfer recording medium of Example 5 was obtained in the same manner as in Example 1, except that the undercoat layer 30 was formed using an undercoat layer coating liquid-3 having the following composition in the thermal transfer recording medium produced in Example 1.

[Undercoat Layer Coating Liquid-3]
Sulfonic acid group-containing polyester
glycidyl group-containing acrylic copolymer (30:70): 1.00 part
Polyvinyl pyrrolidone (K value: 60): 4.00 parts
Pure water: 57.0 parts
Isopropyl alcohol: 38.0 parts Example 6

A thermal transfer recording medium of Example 6 was obtained in the same manner as in Example 1, except that the undercoat layer 30 was formed using an undercoat layer coating liquid-4 having the following composition in the thermal transfer recording medium produced in Example 1.
[Undercoat Layer Coating Liquid-4]
Sulfonic acid group-containing polyester
glycidyl group-containing acrylic copolymer (30:70): 3.50 parts
Polyvinyl pyrrolidone (K value: 60): 1.50 parts
Pure water: 57.0 parts
Isopropyl alcohol: 38.0 parts Example 7

A thermal transfer recording medium of Example 7 was obtained in the same manner as in Example 1, except that the primer layer coating liquid was applied so that the coating amount of the primer layer 20 after drying was 0.03 g/m$^2$, followed by drying, in the thermal transfer recording medium produced in Example 1.

Example 8

A thermal transfer recording medium of Example 8 was obtained in the same manner as in Example 1, except that the primer layer coating liquid was applied so that the coating amount of the primer layer 20 after drying was 0.25 g/m2, followed by drying, in the thermal transfer recording medium produced in Example 1.

Example 9

A thermal transfer recording medium of Example 9 was obtained in the same manner as in Example 1, except that the undercoat layer coating liquid was applied so that the coating amount of the undercoat layer 30 after drying was 0.03 g/m$^2$, followed by drying, in the thermal transfer recording medium produced in Example 1.

Example 10

A thermal transfer recording medium of Example 10 was obtained in the same manner as in Example 1, except that the undercoat layer coating liquid was applied so that the coating amount of the undercoat layer 30 after drying was 0.35 g/m$^2$, followed by drying, in the thermal transfer recording medium produced in Example 1.

Comparative Example 1

The primer layer 20 and the undercoat layer 30 were not formed, and the same dye layer coating liquid as that of Example 1 was applied to the surface of the substrate 10 with a heat-resistant lubricating layer, to which the heat-resistant lubricating layer was not applied, by a gravure coating method so that he coating amount after drying was 0.7 g/m$^2$, followed by drying, thereby forming a dye layer 40. Thus, a thermal transfer recording medium of Comparative Example 1 was obtained.

Comparative Example 2

A thermal transfer recording medium of Comparative Example 2 was obtained in the same manner as in Example 1, without forming the primer layer 20 in the thermal transfer recording medium produced in Example 1.

Comparative Example 3

A thermal transfer recording medium of Comparative Example 3 was obtained in the same manner as in Example 1, except that the primer layer 20 was formed using a primer layer coating liquid-4 having the following composition.
[Primer Layer Coating Liquid-4]
Polyurethane-urea resin: 5.00 parts
(solid content: 30%)
Methyl ethyl ketone: 50.0 parts
Ethyl acetate: 25.0 parts
Toluene: 20.0 parts Comparative Example 4

A thermal transfer recording medium of Comparative Example 4 was obtained in the same manner as in Example 1, except that the primer layer 20 was formed using a primer layer coating liquid-5 having the following composition.
[Primer Layer Coating Liquid-5]
Polyurethane-urea resin: 5.00 parts
(solid content: 30%)
Hexamethylene diisocyanate: 0.60 parts
(solid content: 71%; D-160N, produced by Mitsui Chemicals, Inc.)
Methyl ethyl ketone: 50.0 parts
Ethyl acetate: 25.0 parts
Toluene: 19.4 parts Comparative Example 5

A thermal transfer recording medium of Comparative Example 5 was obtained in the same manner as in Example 1, except that the primer layer 20 was formed using a primer layer coating liquid-6 having the following composition.
[Primer Layer Coating Liquid-6]
Polyurethane-urea resin: 5.00 parts
(solid content: 30%)
Hydrogenated xylylene diisocyanate: 0.60 parts
(solid content: 75%; D-120N, produced by Mitsui Chemicals, Inc.)
Methyl ethyl ketone: 50.0 parts
Ethyl acetate: 25.0 parts
Toluene: 19.4 parts Comparative Example 6

A thermal transfer recording medium of Comparative Example 6 was obtained in the same manner as in Example 1, without forming the undercoat layer 30 in the thermal transfer recording medium produced in Example 1.

Comparative Example 7

A thermal transfer recording medium of Comparative Example 7 was obtained in the same manner as in Example 1, except that the undercoat layer 30 was formed using an undercoat layer coating liquid-5 having the following composition.

[Undercoat Layer Coating Liquid-5]

Sulfonic acid group-containing polyester glycidyl group-containing acrylic copolymer (30:70): 0.50 parts Polyvinyl pyrrolidone (K value: 60): 4.50 parts Pure water: 57.0 parts Isopropyl alcohol: 38.0 parts Comparative Example 8

A thermal transfer recording medium of Comparative Example 8 was obtained in the same manner as in Example 1, except that the undercoat layer 30 was formed using an undercoat layer coating liquid-6 having the following composition.

[Undercoat Layer Coating Liquid-6]

Sulfonic acid group-containing polyester/ glycidyl group-containing acrylic copolymer (30:70): 4.00 parts

Polyvinyl pyrrolidone (K value: 60): 1.00 part

Pure water: 57.0 parts

Isopropyl alcohol: 38.0 parts

Comparative Example 9

A thermal transfer recording medium of Comparative Example 9 was obtained in the same manner as in Example 1, except that the undercoat layer 30 was formed using a coating liquid-7 for the undercoat layer 30 having the following composition.

[Undercoat Layer Coating Liquid-7]

Polyvinyl pyrrolidone (K value: 60): 5.00 parts

Pure water: 57.0 parts

Isopropyl alcohol: 38.0 parts

Comparative Example 10

A thermal transfer recording medium of Comparative Example 10 was obtained in the same manner as in Example 1, except that the undercoat layer 30 was formed using an undercoat layer coating liquid-8 having the following composition in the thermal transfer recording medium produced in Example 1.

[Coating Liquid-8 for Undercoat Layer 30]

Sulfonic acid group-containing polyester resin: 10.0 parts

Pure water: 45.0 parts

Isopropyl alcohol: 45.0 parts

Comparative Example 11

A thermal transfer recording medium of Comparative Example 11 was obtained in the same manner as in Example 1, except that the undercoat layer 30 was formed using an undercoat layer coating liquid-9 having the following composition in the thermal transfer recording medium produced in Example 1.

[Undercoat Layer Coating Liquid-9]

Glycidyl group-containing acrylic resin: 10.0 parts

Pure water: 45.0 parts

Isopropyl alcohol: 45.0 parts

Comparative Example 12

A thermal transfer recording medium of Comparative Example 12 was obtained in the same manner as in Example 1, except that the undercoat layer 30 was formed using a coating liquid-10 for the undercoat layer 30 having the following composition.

[Undercoat Layer Coating Liquid-10]

Sulfonic acid group-containing polyester/ glycidyl group-containing acrylic copolymer (30:70): 5.00 parts

Pure water: 57.0 parts

Isopropyl alcohol: 38.0 parts

Comparative Example 13

A thermal transfer recording medium of Comparative Example 13 was obtained in the same manner as in Example 1, except that the undercoat layer 30 was formed using an undercoat layer coating liquid-11 having the following composition in the thermal transfer recording medium produced in Example 1.

[Undercoat Layer Coating Liquid-11]

Glycidyl group-containing acrylic resin: 7.00 parts

Sulfonic acid group-containing polyester resin: 3.00 parts

Pure water: 45.0 parts

Isopropyl alcohol: 45.0 parts

Comparative Example 14

A thermal transfer recording medium of Comparative Example 14 was obtained in the same manner as in Example 1, except that the primer layer coating liquid was applied so that the coating amount of the primer layer 20 after drying was 0.01 g/m$^2$, followed by drying, in the thermal transfer recording medium produced in Example 1.

Comparative Example 15

A thermal transfer recording medium of Comparative Example 15 was obtained in the same manner as in Example 1, except that the primer layer coating liquid was applied so that the coating amount of the primer layer 20 after drying was 0.30 g/m$^2$, followed by drying, in the thermal transfer recording medium produced in Example 1.

Comparative Example 16

A thermal transfer recording medium of Comparative Example 16 was obtained in the same manner as in Example 1, except that the undercoat layer coating liquid was applied so that the coating amount of the undercoat layer 30 after drying was 0.01 g/m$^2$, followed by drying, in the thermal transfer recording medium produced in Example 1.

Comparative Example 17

A thermal transfer recording medium of Comparative Example 17 was obtained in the same manner as in Example 1, except that the undercoat layer coating liquid was applied so that the coating amount of the undercoat layer 30 after drying was 0.40 g/m$^2$, followed by drying, in the thermal transfer recording medium produced in Example 1.

[Production of Transfer Object]

A water-based thermal transfer image-receiving sheet was produced in the following manner.

[Preparation of Image Receiver Substrate]

Art paper having a thickness of 180 g/m$^2$ was used as an image receiver substrate.

[Formation of Hollow Particle Layer]

A hollow particle layer coating liquid having the following composition was applied to the image receiver substrate by a gravure coating method so that the coating amount after drying was 10 g/m$^2$, and then dried, followed by aging in a 40° C. environment for one week, thereby obtaining an image receiver with a hollow particle layer.

[Hollow Particle Layer Coating Liquid]

Foamed hollow particles containing a copolymer comprising acrylonitrile and methacrylonitrile as main components: 45 parts (average particle diameter: 3.2 μm, volume hollow ratio: 85%)

Polyvinyl alcohol: 10 parts

Vinyl chloride-vinyl acetate copolymer resin dispersion: 45 parts (vinyl chloride/vinyl acetate=70/30; Tg: 64° C.).

Water: 200 parts

[Formation of Receiving Layer]

A receiving layer coating liquid having the following composition was applied to a heat insulating layer by a gravure coating method so that the coating amount after drying was 4 g/m$^2$, and then dried, followed by aging in a 40° C. environment for one week, thereby obtaining a receiving layer.

[Receiving Layer Coating Liquid]

Vinyl chloride-vinyl acetate copolymer resin dispersion: 80 parts (e.g., Vinyblan 900, produced by Nissin Chemical Industry Co., Ltd.)

Polyether-modified silicone: 10 parts (e.g., KF615A, produced by Shin-Etsu Chemical Co., Ltd.)

Water: 400 parts

[Printing Evaluation]

Using the thermal transfer recording media of Examples 1 to 10 and Comparative Examples 1 to 17, solid printing was conducted by a thermal simulator, and the maximum reflection density was evaluated. Table 2 shows the results. Note that the maximum reflection density is a value measured by X-Rite 528.

The printing conditions are as follows.

Printing environment: 23° C. 55% RH

Applied voltage: 29 V

Line cycle: 0.9 msec

Printing density: main scanning 300 dpi, sub-scanning 300 dpi

[Evaluation of Abnormal Transfer]

Regarding the thermal transfer recording media of Examples 1 to 10 and Comparative Examples 1 to 17, solid printing was conducted by a thermal simulator in a 40° C. 85% environment using the thermal transfer recording media stored at ordinary temperature and the thermal transfer recording media stored in a 40° C. 90% environment for 168 hours and further at ordinary temperature for 24 hours, as well as the transfer objects; and the presence of abnormal transfer was evaluated. Table 2 shows the results.

Abnormal transfer was evaluated on the basis of the following criteria. "No abnormal transfer" and "Slight abnormal transfer" are levels that do not cause any practical problems.

No abnormal transfer: abnormal transfer to the transfer object was not observed.

Slight abnormal transfer: abnormal transfer to the transfer object was slightly observed.

Partial abnormal transfer: abnormal transfer to the transfer object was partially observed.

Entire abnormal transfer: abnormal transfer to the transfer object was observed on the entire surface.

TABLE 2

| | Coating amount of primer layer after drying [g/m2] | Polyisocyanate | Coating amount of undercoat layer after drying [g/m$^2$] | Polyester-acrylic copolymerization ratio | | |
|---|---|---|---|---|---|---|
| | | | | Sulfonic acid group-containing polyester | Glycidyl group-containing acrylic | Carboxyl group-containing acrylic |
| Example 1 | 0.10 | TDI | 0.20 | 30 | 70 | — |
| Example 2 | 0.10 | XDI | 0.20 | 30 | 70 | — |
| Example 3 | 0.10 | MDI | 0.20 | 30 | 70 | — |
| Example 4 | 0.10 | TDI | 0.20 | 30 | — | 70 |
| Example 5 | 0.10 | TDI | 0.20 | 30 | 70 | — |
| Example 6 | 0.10 | TDI | 0.20 | 30 | 70 | — |
| Example 7 | 0.03 | TDI | 0.20 | 30 | 70 | — |
| Example 8 | 0.25 | TDI | 0.20 | 30 | 70 | — |
| Example 9 | 0.10 | TDI | 0.03 | 30 | 70 | — |
| Example 10 | 0.10 | TDI | 0.35 | 30 | 70 | — |
| Comparative Example 1 | — | — | — | — | — | — |
| Comparative Example 2 | — | — | 0.20 | 30 | 70 | — |
| Comparative Example 3 | 0.10 | — | 0.20 | 30 | 70 | — |
| Comparative Example 4 | 0.10 | HDI | 0.20 | 30 | 70 | — |
| Comparative Example 5 | 0.10 | HXDI | 0.20 | 30 | 70 | — |
| Comparative Example 6 | 0.10 | TDI | — | — | — | — |
| Comparative Example 7 | 0.10 | TDI | 0.20 | 30 | 70 | — |
| Comparative Example 8 | 0.10 | TDI | 0.20 | 30 | 70 | — |
| Comparative Example 9 | 0.10 | TDI | 0.20 | — | — | — |

TABLE 2-continued

| | | | | | | |
|---|---|---|---|---|---|---|
| Comparative Example 10 | 0.10 | TDI | 0.20 | 100 | — | — |
| Comparative Example 11 | 0.10 | TDI | 0.20 | — | 100 | — |
| Comparative Example 12 | 0.10 | TDI | 0.20 | 30 | 70 | — |
| Comparative Example 13 | 0.10 | TDI | 0.20 | Polyester/glycidyl group-containing acrylic blend (30/70) | | |
| Comparative Example 14 | 0.01 | TDI | 0.20 | 30 | 70 | — |
| Comparative Example 15 | 0.30 | TDI | 0.20 | 30 | 70 | — |
| Comparative Example 16 | 0.10 | TDI | 0.01 | 30 | 70 | — |
| Comparative Example 17 | 0.10 | TDI | 0.40 | 30 | 70 | — |

| | (weight ratio) (A) Polyester-acrylic copolymer:PVP (weight ratio) (B) | Maximum reflection density (255/255) | Abnormal transfer evaluation Storage environment 23° C. 55% 168 hours | 40° C. 90% 168 hours |
|---|---|---|---|---|
| Example 1 | 50:50 | 2.63 | No abnormal transfer | 40° C. 90% |
| Example 2 | 50:50 | 2.63 | No abnormal transfer | 168 hours |
| Example 3 | 50:50 | 2.63 | No abnormal transfer | No abnormal transfer |
| Example 4 | 50:50 | 2.59 | No abnormal transfer | No abnormal transfer |
| Example 5 | 20:80 | 2.53 | No abnormal transfer | No abnormal transfer |
| Example 6 | 70:30 | 2.65 | No abnormal transfer | No abnormal transfer |
| Example 7 | 50:50 | 2.58 | No abnormal transfer | No abnormal transfer |
| Example 8 | 50:50 | 2.63 | No abnormal transfer | No abnormal transfer |
| Example 9 | 50:50 | 2.57 | No abnormal transfer | Slight abnormal transfer |
| Example 10 | 50:50 | 2.62 | No abnormal transfer | Slight abnormal transfer |
| Comparative Example 1 | — | 1.85 | Entire abnormal transfer | Slight abnormal transfer |
| Comparative Example 2 | 50:50 | 2.49 | Partial abnormal transfer | Slight abnormal transfer |
| Comparative Example 3 | 50:50 | 2.59 | No abnormal transfer | Entire abnormal transfer |
| Comparative Example 4 | 50:50 | 2.59 | No abnormal transfer | Entire abnormal transfer |
| Comparative Example 5 | 50:50 | 2.59 | No abnormal transfer | Entire abnormal transfer |
| Comparative Example 6 | — | 1.75 | Slight abnormal transfer | Partial abnormal transfer |
| Comparative Example 7 | 10:90 | 2.35 | Slight abnormal transfer | Partial abnormal transfer |
| Comparative Example 8 | 80:20 | 2.60 | Partial abnormal transfer | Slight abnormal transfer |
| Comparative Example 9 | 0:100 | 2.21 | Slight abnormal transfer | Slight abnormal transfer |
| Comparative Example 10 | — | 1.80 | Slight abnormal transfer | Partial abnormal transfer |
| Comparative Example 11 | — | 2.49 | Entire abnormal transfer | Partial abnormal transfer |

TABLE 2-continued

| | | | | |
|---|---|---|---|---|
| Comparative Example 12 | 100:0 | 2.43 | Entire abnormal transfer | Partial abnormal transfer |
| Comparative Example 13 | Polyester/glycidyl group-containing acrylic blend (30/70) | 2.05 | Entire abnormal transfer | Entire abnormal transfer |
| Comparative Example 14 | 50:50 | 2.53 | Slight abnormal transfer | Partial abnormal transfer |
| Comparative Example 15 | 50:50 | 2.63 | No abnormal transfer | No abnormal transfer |
| Comparative Example 16 | 50:50 | 2.49 | Slight abnormal transfer | Partial abnormal transfer |
| Comparative Example 17 | 50:50 | 2.62 | No abnormal transfer | No abnormal transfer |

XDI: Xylene diisocyanate
TDI: Tolylene diisocyanate
MDI: Diphenylmethane diisocyanate
HDI: Hexamethylene diisocyanate
HXDI: Hydrogenated xylylene diisocyanate The results shown in Table 2 revealed that Examples 1 to 10, in which polycarbonate, a polyurethane-urea resin having a polycaprolactam skeleton, and a polyisocyanate were used in the primer layer 20, and a polyester-acrylic copolymer and polyvinyl pyrrolidone were used in the undercoat layer 30, showed an improvement in transfer sensitivity and did not undergo abnormal transfer even after storage under high-temperature and high-humidity conditions, in comparison to Comparative Examples 1 and 2, in which the primer layer 20 was not provided, Comparative Example 3, in which the primer layer 20 did not contain a polyisocyanate, and Comparative Example 6, in which the undercoat layer was not provided.

It was also revealed that Comparative Example 12, in which a copolymer of sulfonic acid group-containing polyester and glycidyl group-containing acrylic was used in the undercoat layer 30, had higher transfer sensitivity during high-speed printing, in comparison to Comparative Example 1, in which the undercoat layer 30 was not provided, Comparative Example 10, in which only sulfonic acid group-containing polyester was used, and Comparative Example 13, in which sulfonic acid group-containing polyester and glycidyl group-containing acrylic were simply mixed.

Moreover, when Example 1, in which polyvinyl pyrrolidone was mixed with a polyester-acrylic copolymer, was compared with Comparative Example 9, in which polyvinyl pyrrolidone was used alone, and Comparative Example 12, in which a polyester-acrylic copolymer was used alone, it was confirmed that the maximum reflection density was improved by mixing polyvinyl pyrrolidone. This demonstrated that transfer sensitivity was further increased when polyvinyl pyrrolidone was mixed with a polyester-acrylic copolymer.

Further, there was a tendency that transfer sensitivity was reduced when the ratio of polyvinyl pyrrolidone to the polyester-acrylic copolymer increased (see Examples 1, 5, and 6, and Comparative Examples 7 and 8).

There was also a tendency that adhesion was reduced when the ratio of polyvinyl pyrrolidone decreased. These tendencies indicated that the mixing ratio of the polyester-acrylic copolymer and the polyvinyl pyrrolidone was preferably within a range of 70:30 to 20:80 by mass ratio.

Moreover, Examples 1 to 3 and Comparative Examples 4 and 5 revealed that the polyisocyanate used in the primer layer 20 was preferably diphenylmethane diisocyanate, tolylene diisocyanate, or xylene diisocyanate, in terms of adhesion and transfer sensitivity.

Moreover, in the thermal transfer recording medium of Example 7, the coating amount of the primer layer 20 was 0.03 g/m$^2$; thus, a very slight reduction was confirmed in transfer sensitivity and adhesion, in comparison to the thermal transfer recording medium of Example 1. However, this reduction is a level causing no practical problems.

On the other hand, in the thermal transfer recording medium of Comparative Example 14, the coating amount of the primer layer 20 was 0.01 g/m$^2$; thus, transfer sensitivity was not improved, and adhesion was reduced, in comparison to the thermal transfer recording medium of Example 1. Further, abnormal transfer was confirmed.

Moreover, when the thermal transfer recording medium of Example 8, in which the coating amount of the primer layer 20 was 0.25 g/m$^2$, was similarly compared with the thermal transfer recording medium of Example 1, it was revealed that their transfer sensitivity and their adhesion were almost equivalent.

On the other hand, when the thermal transfer recording medium of Comparative Example 15, in which the coating amount of the primer layer 20 was 0.30 g/m$^2$, was similarly compared with the thermal transfer recording medium of Example 1, transfer sensitivity and adhesion were saturated; this is not preferable in terms of cost.

Moreover, in the thermal transfer recording medium of Example 9, the coating amount of the undercoat layer 30 was 0.03 g/m$^2$; thus, a very slight reduction was confirmed in transfer sensitivity, in comparison to the thermal transfer recording medium of Example 1. However, this reduction is a level causing no practical problems.

On the other hand, in the thermal transfer recording medium of Comparative Example 16, the coating amount of the undercoat layer 30 was 0.01 g/m$^2$; thus, a reduction was confirmed in transfer sensitivity and adhesion, in comparison to the thermal transfer recording medium of Example 1. Further, abnormal transfer was confirmed.

Moreover, when the thermal transfer recording medium of Example 10, in which the coating amount of the undercoat layer 30 was 0.35 g/m$^2$, was similarly compared with the thermal transfer recording medium of Example 1, it was revealed that their transfer sensitivity and their adhesion were almost equivalent.

On the other hand, when the thermal transfer recording medium of Comparative Example 17, in which the coating amount of the undercoat layer 30 was 0.40 g/m$^2$, was similarly compared with the thermal transfer recording medium of Example 1, transfer sensitivity and adhesion were saturated; this is not preferable in terms of cost.

Although the present invention was explained with reference to the embodiments, the scope of the present invention is not limited to the exemplary embodiments shown in the drawing, and includes all embodiments that result in effects equivalent to those targeted by the present invention. Furthermore, the scope of the present invention is not limited to the combination of the features of the invention defined in the claims, but can be defined by various desired combinations of specific features of all the features disclosed herein.

INDUSTRIAL APPLICABILITY

The thermal transfer recording medium obtained in the present invention can be used for sublimation transfer printers, and can easily form various images in full color, together with higher speed and higher performance of the printers. Therefore, the thermal transfer recording medium of the present invention can be widely used for self-printing of digital camera photos, cards such as identification cards, output objects for amusement, and the like.

REFERENCE SIGNS LIST

1 . . . Thermal transfer recording medium; 10 . . . Substrate; 20 . . . Primer layer; 30 . . . Undercoat layer; 40 . . . Dye layer; 50 . . . Heat-resistant lubricating layer.

What is claimed is:

1. A thermal transfer recording medium, comprising:

a primer layer, an undercoat layer, and a dye layer are laminated in this order on one surface of a substrate, and a heat-resistant lubricating layer is provided on the other surface of the substrate;

wherein the primer layer contains polycarbonate and a polyurethane-urea resin having a polycaprolactam skeleton; and, wherein the undercoat layer contains a copolymer of a polyester having a sulfonic acid group and an acrylic having at least one of a glycidyl group and a carboxyl group, and a polyvinyl pyrrolidone.

2. The thermal transfer recording medium of claim 1, wherein the polyurethane-urea resin contained in the primer layer has a hydroxyl value of 10 mgKOH/g or more and 30 mgKOH/g or less.

3. The thermal transfer recording medium of claim 1, wherein the primer layer further contains a polyisocyanate.

4. The thermal transfer recording medium of claim 3, wherein the polyisocyanate is at least one selected from the group consisting of diphenylmethane diisocyanate, tolylene diisocyanate, and xylene diisocyanate.

5. The thermal transfer recording medium of claim 1, wherein the composition ratio of the copolymer and the polyvinyl pyrrolidone contained in the undercoating layer is within a range of 70:30 to 20:80 by mass ratio.

6. The thermal transfer recording medium of claim 1, wherein the mass per unit area of the primer layer in a dry state is within a range of 0.03 g/m$^2$ or more and 0.25 g/m$^2$ or less.

7. The thermal transfer recording medium of claim 1, wherein the mass per unit area of the undercoat layer in a dry state is within a range of 0.03 g/m$^2$ or more and 0.35 g/m$^2$ or less.

* * * * *